US010814243B2

(12) United States Patent
Clayton et al.

(10) Patent No.: US 10,814,243 B2
(45) Date of Patent: Oct. 27, 2020

(54) APPARATUS AND METHOD FOR GENERATING BUBBLES

(71) Applicant: Honor Metro Limited, Tsim Sha Tsui, Kowloon (HK)

(72) Inventors: Richard Clayton, Simi Valley, CA (US); Nai Cheng Yang, Temple City, CA (US)

(73) Assignee: HONOR METRO LIMITED, Hong Kong (HK)

( * ) Notice: Subject to any disclaimer, the term of this patent is extended or adjusted under 35 U.S.C. 154(b) by 48 days.

(21) Appl. No.: 16/192,909

(22) Filed: Nov. 16, 2018

(65) Prior Publication Data

US 2020/0155957 A1 May 21, 2020

(51) Int. Cl.
*A63H 33/28* (2006.01)
*A63H 29/22* (2006.01)

(52) U.S. Cl.
CPC ..... *A63H 33/28* (2013.01); *A63H 29/22* (2013.01)

(58) Field of Classification Search
CPC ..... A63H 33/28; A63H 29/22
USPC ..... 446/15, 16, 20
See application file for complete search history.

(56) References Cited

U.S. PATENT DOCUMENTS 2,452,794 A 11/1948 Saachy
2,632,281 A 3/1953 Schmidt, Jr.
2,942,375 A 6/1960 Bucic, Jr.
4,775,348 A 10/1988 Collins
D353,166 S 12/1994 Kwak
5,462,469 A * 10/1995 Lei ..... A63H 33/28 446/15
5,832,969 A * 11/1998 Schramm ..... A63H 33/28 141/98
6,102,764 A 8/2000 Thai
6,200,184 B1 3/2001 Rich et al.
6,328,286 B1 12/2001 Sanchez et al.
6,331,130 B1 12/2001 Thai
6,572,427 B1 * 6/2003 Thai ..... A63H 33/28 446/15
6,682,570 B2 * 1/2004 Thai ..... A63H 33/28 446/15

(Continued)

FOREIGN PATENT DOCUMENTS

CA 2824412 8/2012
CN 2103358 U 5/1992

(Continued)

*Primary Examiner* — Joseph B Baldori
(74) *Attorney, Agent, or Firm* — Belles Katz LLC

(57) ABSTRACT

A bubble generating device and a method for producing bubbles. In one aspect, the invention can be an apparatus for generating bubbles including an housing assembly, a motor, and a fan device operably coupled to the motor to generate an air stream. There may also be a bubble generating assembly having a plurality of bubble generating devices that are aligned with the air stream generated by the fan device. The bubble solution dispenser may include a storage reservoir containing a supply of a bubble solution and a delivery reservoir that is fluidly coupled to the storage reservoir. The motor may be operably coupled to the bubble solution dispenser to rotate the bubble solution dispenser about a rotational axis to deliver the bubble solution to each of the bubble generating devices.

15 Claims, 21 Drawing Sheets

(56) References Cited

U.S. PATENT DOCUMENTS

| | | | | |
|---|---|---|---|---|
| 6,820,662 | B2 * | 11/2004 | Crawford | A63H 33/28 141/198 |
| 7,021,986 | B2 | 4/2006 | Thai | |
| 7,144,291 | B2 | 12/2006 | Thai | |
| 7,172,484 | B2 | 2/2007 | Thai | |
| 7,780,497 | B2 | 8/2010 | Thai | |
| 8,123,584 | B2 | 2/2012 | Thai | |
| 8,272,915 | B2 | 9/2012 | Thai | |
| 8,272,916 | B2 | 9/2012 | Thai | |
| 9,339,737 | B2 | 5/2016 | Chan | |
| D790,009 | S | 6/2017 | Lo et al. | |
| 9,884,262 | B2 * | 2/2018 | Huey | A63H 33/28 |
| 10,363,492 | B1 * | 7/2019 | Thai | A63H 33/28 |
| 2002/0090878 | A1 * | 7/2002 | Holmes | A63H 33/28 446/15 |
| 2003/0116224 | A1 | 6/2003 | Crawford et al. | |
| 2009/0163109 | A1 | 6/2009 | Thai | |
| 2009/0209163 | A1 | 8/2009 | Thai | |
| 2010/0173558 | A1 | 7/2010 | Huey et al. | |
| 2012/0220184 | A1 | 8/2012 | Orem et al. | |
| 2015/0133021 | A1 | 5/2015 | Huey | |
| 2018/0272245 | A1 | 9/2018 | Pogue et al. | |

FOREIGN PATENT DOCUMENTS

| | | | |
|---|---|---|---|
| CN | 2907803 | Y | 6/2007 |
| CN | 2907813 | Y | 6/2007 |
| CN | 2930817 | Y | 8/2007 |
| CN | 201055703 | Y | 5/2008 |
| CN | 20167639 | Y | 6/2008 |
| CN | 202427173 | U | 9/2012 |
| EP | 2921213 | | 9/2015 |
| WO | 2004/012831 | | 2/2004 |

* cited by examiner

APPARATUS AND METHOD FOR GENERATING BUBBLES

BACKGROUND OF THE INVENTION

Children love bubbles and the bubble makers that are used to create them. At least as far as children are concerned, there is a general understanding that the more bubbles that are made and the quicker they are made, the better the bubble maker. Simple wands that produce bubbles by loading the wands with a bubble solution and blowing through the wands with air from a person's mouth are well known. Furthermore, certain types of automated bubble producing devices, such as bubble producing guns, are also known. However, these types of devices can make a terrible mess in the hands of a child (the same goes for some adults, too). For purposes of generating more bubbles, and making less of a mess, stand-alone bubble generating toys have been designed. Such a toy generates bubbles by forming a film of bubble solution using an applicator as air streams through bubble-forming openings. This type of bubble generating toy requires bubble solution to be pumped from a reservoir at the base of the assembly and streamed over the bubble-forming openings. Furthermore, excess bubble solution must be collected so that it can be directed back into the reservoir. Toys of this type also blow air through small air tubes, which direct the air to the bubble-forming openings to help form the bubbles. Existing automated bubble making devices are messy, difficult and expensive to manufacture, and difficult to use. Thus, a need exists for an apparatus for generating bubbles which overcomes the above-noted deficiencies.

BRIEF SUMMARY OF THE INVENTION

Exemplary embodiments according to the present disclosure are directed to an apparatus for generating bubbles and to a method of generating bubbles. The apparatus may include a modular assembly that includes a first housing assembly containing a fan device, bubble generating devices, and a bubble solution dispenser, a second housing assembly containing all of the electronic circuitry of the apparatus, and a drip tray. The second housing assembly, the drip tray, and the first housing assembly may be detachably coupled together by simply placing each component on top of the other such that gravity and no fasteners are used to hold the parts together. In some embodiments, operation of the apparatus involves the motor being operably coupled to the fan device and to the bubble solution dispenser to rotate them both about a rotational axis. The bubble solution dispenser may deliver bubble solution onto the bubble generating devices as it rotates and an air stream generated by the fan device may pass through the bubble generating devices to generate bubbles from the bubble solution loaded thereon.

In one aspect, the invention may be an apparatus for generating bubbles comprising: a first housing assembly; a motor; a fan device operably coupled to the motor to generate an air stream; a bubble generating assembly comprising a plurality of bubble generating devices that are aligned with the air stream generated by the fan device, the plurality of bubble generating devices fixed relative to the first housing assembly; a bubble solution dispenser comprising at least one delivery member that is fluidly coupled to a supply of a bubble solution; and wherein the motor is operably coupled to the bubble solution dispenser to move the delivery member across each of the bubble generating devices to load each of the bubble generating devices with the bubble solution.

In another aspect, the invention may be a method of generating bubbles comprising: generating an air stream with an air stream generator; moving at least one delivery member that is fluidly coupled to a source of a bubble solution across one or more stationary bubble generating devices, thereby loading the one or more stationary bubble generating devices with the bubble solution; and flowing the air stream through the one or more stationary bubble generating devices to produce bubbles from the bubble solution that has been loaded on the one or more stationary bubble generating devices.

In yet another aspect, the invention may be an apparatus for generating bubbles comprising: a first housing assembly containing a fan device, a bubble generating assembly, and a bubble solution reservoir; a second housing assembly comprising an interior cavity, a power source and a motor positioned in the interior cavity and operably coupled together, a drive shaft of the motor protruding from the second housing assembly; a drip tray comprising a collection reservoir; and wherein the first housing assembly, the drip tray, and the second housing assembly are detachably coupled together with the drip tray located in between the first and second housing assemblies, the drive shaft of the motor operably coupled to the fan device to rotate the fan device about a rotational axis to generate an air stream.

In a further aspect, the invention may be an apparatus for generating bubbles comprising: a housing assembly extending along a longitudinal axis; a motor; a fan device operably coupled to the motor to generate an air stream; a bubble generating assembly comprising at least one bubble generating device that is aligned with the air stream generated by the fan device; and a support member coupled to the housing assembly and configured to support a bubble solution bottle in an upside-down orientation at a position so that the longitudinal axis of the first housing intersects the bubble solution bottle, the bubble solution bottle fluidly coupled to the at least one bubble generating device when in the upside-down orientation at the position.

In a still further aspect, the invention may be an apparatus for generating bubbles comprising: a housing assembly; a motor; a fan device operably coupled to the motor to generate an air stream; a bubble generating assembly comprising at least one bubble generating device that is aligned, or can be brought into alignment, with the air stream generated by the fan device; and at least one paddle configured to drive bubble solution toward the at least one bubble generating device of the bubble generating assembly.

In another aspect, the invention may be an apparatus for generating bubbles comprising: a first housing assembly; a motor; a fan device operably coupled to the motor to generate an air stream; a bubble generating assembly comprising a plurality of bubble generating devices that are aligned with the air stream generated by the fan device; a bubble solution dispenser comprising: a hub portion comprising a storage reservoir containing a supply of a bubble solution; and at least one delivery member extending from the hub portion and comprising a delivery reservoir that is fluidly coupled to the storage reservoir; and wherein the motor is operably coupled to one of the bubble generating assembly or the bubble solution dispenser to cause relative rotation between the bubble generating assembly and the bubble solution dispenser so that the delivery member of the bubble solution dispenser can deliver the bubble solution to each of the bubble generating devices, and wherein bubbles are generated as the air stream passes the bubble generating devices that are loaded with the bubble solution.

In a further aspect, the invention may be an apparatus for generating bubbles comprising: a housing assembly extending along a longitudinal axis; a motor positioned within the housing assembly; a fan device operably coupled to the motor to generate an air stream that exits the housing assembly through an open top end of the housing assembly, the open top end defined by an upper edge of the housing assembly; a bubble generating assembly comprising at least one bubble generating device positioned radially inward of the upper edge; and a support member configured to support a bubble solution bottle in an upside-down orientation at a position that is radially inward from the air stream so that the bubble solution bottle is at least partially surrounded by the air stream during operation of the fan device.

In a still further aspect, the invention may be an apparatus for generating bubbles comprising: a housing assembly; a motor; a fan device operably coupled to the motor to generate an air stream; a bubble generating assembly comprising a plurality of bubble generating devices that are aligned with the air stream generated by the fan device; a support member supporting a bottle containing a supply of a bubble solution in an upside-down orientation; a bubble solution dispenser comprising at least one delivery member; wherein the motor is operably coupled to the bubble solution dispenser to move the at least one delivery member of the bubble solution dispenser across each of the bubble generating devices to load each of the bubble generating devices with the bubble solution; and wherein the delivery member of the bubble solution dispenser is fluidly coupled to the supply of the bubble solution when the bubble solution dispenser is being moved by the motor, and wherein the delivery member of the bubble solution dispenser is not fluidly coupled to the supply of the bubble solution when the bubble solution dispenser is not being moved by the motor.

In a yet further aspect, the invention may be an apparatus for generating bubbles comprising: a housing assembly; a motor; a fan device operably coupled to the motor to generate an air stream; a bubble generating assembly comprising a plurality of bubble generating devices that are aligned with the air stream generated by the fan device; a support member supporting a bottle containing a supply of a bubble solution in an upside-down orientation; a bubble solution dispenser comprising at least one delivery member; wherein the motor is operably coupled to the bubble solution dispenser to move the at least one delivery member of the bubble solution dispenser across each of the bubble generating devices to load each of the bubble generating devices with the bubble solution; and wherein the bubble solution is only delivered to the delivery member of the bubble solution dispenser when the bubble solution dispenser is being moved by the motor.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE INVENTION

Figure 1:
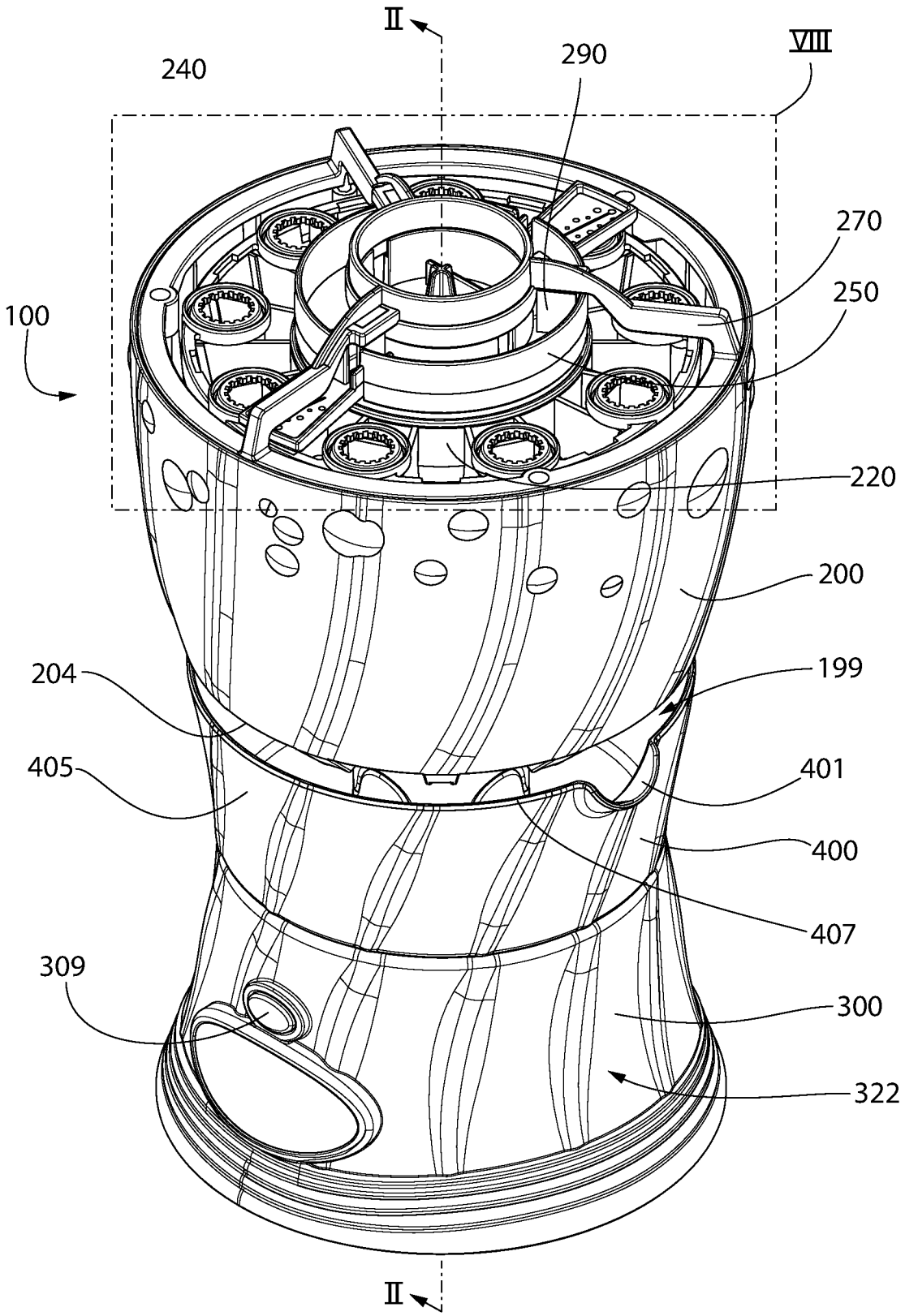
FIG. 1 is a front perspective view of an apparatus for generating bubbles in accordance with an embodiment of the present invention.

The following description of the preferred embodiment(s) is merely exemplary in nature and is in no way intended to limit the invention, its application, or uses.

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "top" and "bottom" as well as derivatives thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached,"

"affixed," "connected," "coupled," "interconnected," and similar refer to a relationship wherein structures are secured or attached to one another either directly or indirectly through intervening structures, as well as both movable or rigid attachments or relationships, unless expressly described otherwise. Moreover, the features and benefits of the invention are illustrated by reference to the exemplified embodiments. Accordingly, the invention expressly should not be limited to such exemplary embodiments illustrating some possible non-limiting combination of features that may exist alone or in other combinations of features; the scope of the invention being defined by the claims appended hereto.

Figure 2:
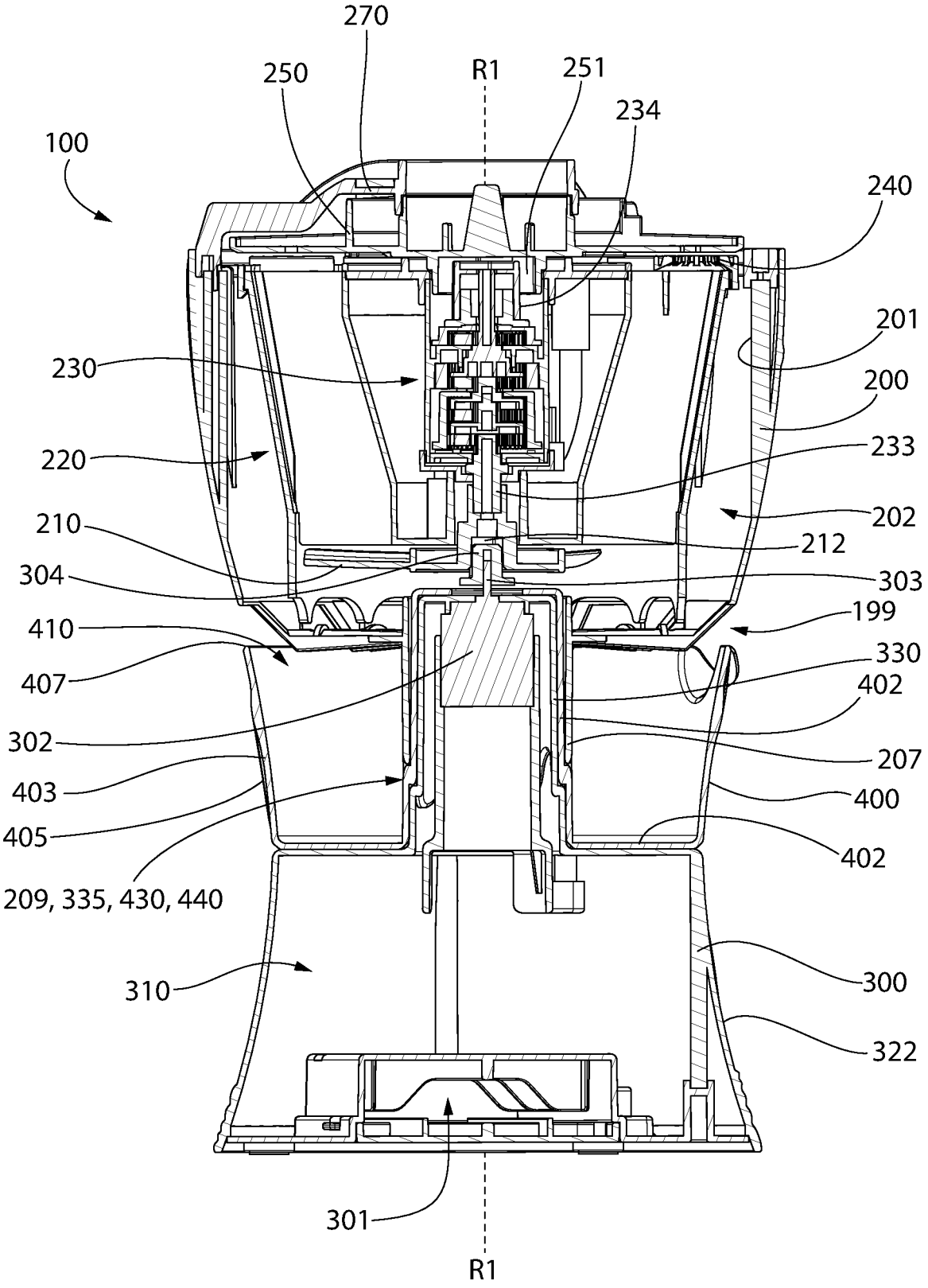
FIG. 2 is a cross-sectional view taken along line II-II of FIG. 1.
Figure 3:
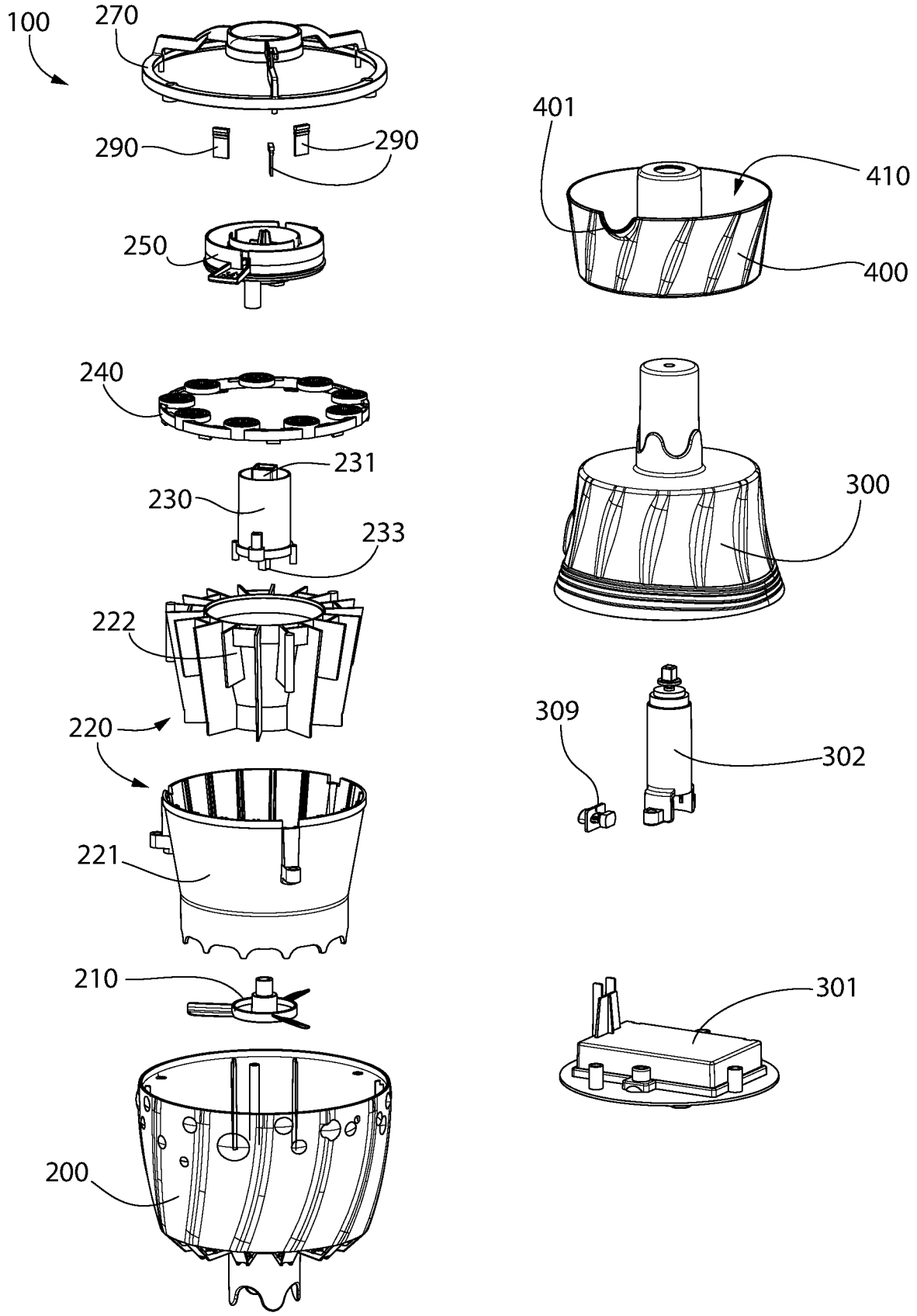
FIG. 3 is an exploded view of the apparatus of FIG. 1.

Referring first to FIGS. 1-3, an apparatus for generating bubbles 100 (hereinafter referred to as the apparatus 100) will be described. The apparatus 100 may also be referred to herein as a bubble generating machine. The apparatus 100 is designed to generate bubbles from a bubble solution in an automatic fashion by way of moving parts that are operably coupled to a motor. Thus, a bubble solution may be dispensed onto bubble generating devices and then bubbles can be generated from the bubble solution loaded on the bubble generating devices as an air stream flows through the bubble generating devices. In some embodiments, there are no pumps, valves, or other similar types of devices included for facilitating movement of the bubble solution to the bubble generating devices. Thus, the apparatus 100 may be devoid of any pumps in some embodiments.

The apparatus 100 generally comprises a first housing assembly 200, a second housing assembly 300, and a drip tray 400. The apparatus 100 is assembled by detachably coupling the drip tray 400 to the second housing assembly 300 and then detachably coupling the first housing assembly 200 to the drip tray 400. Thus, the second housing assembly 300, the drip tray 400, and the first housing assembly 200 are detachably coupled together to form the assembled apparatus 100. Stated another way, the drip tray 400 is slidably coupled to the second housing assembly 300 and then the first housing assembly 200 is slidably coupled to the drip tray 400 and the first housing assembly 200, the drip tray 400, and the second housing assembly 300 are maintained in an assembled state due to gravity.

In the exemplified embodiment, there are no mechanical fasteners involved in the coupling of the various components together. Rather, the drip tray 400 merely rests atop of the second housing assembly 300 via gravity and the first housing assembly 200 merely rests atop of the drip tray 400 via gravity. Thus, a user can very easily assemble and disassemble the apparatus 100 as desired, which is particularly helpful for purposes of cleaning the apparatus 100 after each use. To disassemble the apparatus 100, the user lifts the first housing assembly 200 upwardly away from the drip tray 400, then lifts the drip tray 400 upwardly away from the second housing assembly 200. There are no screws, fasteners, or other hardware involved in the assembly and disassembly, which makes it very simple for an end-user such as a very busy parent.

Each of the first and second housing assemblies 200, 300 and the drip tray 400 will be described separately in greater detail below. However, briefly with continued reference to FIGS. 1-3, the first housing assembly 200 comprises an inner surface 201 that defines an interior space 202 that contains several components of the apparatus 100. Specifically, the following components are either located within (partially or entirely) the interior space 202 of the first housing assembly 200 or coupled to the first housing assembly 200 without being located within the interior space 202: a fan device 210, an air guide 220 having an outer casing 221 and an inner funnel 222 that collectively define an air passageway therebetween, a gear assembly 230, a bubble generating assembly 240, a bubble solution dispenser 250, a support member 270, and one or more paddles 290. In general, the fan device 210, the air guide 220, the gear assembly 230, and the bubble generating assembly 240 are located at least partially within the interior space 202 defined by the first housing assembly 200. The bubble solution dispenser 250 is operably coupled to the fan device 210 via the gear assembly 230, but in the exemplified embodiment at least a part of the bubble solution dispenser 250 may not be located within the interior space 202 (although in other embodiments the bubble solution dispenser 250 could certainly be located entirely within the interior space 202). Furthermore, although a portion of the support member 270 may be located within the interior space 202, another portion of the support member 270 may be located outside of the interior space 202. Of course, the shape and design of the first housing assembly 200 may be modified as desired to contain all of these components within the interior space 202 in some embodiments. The first housing assembly 200 is open at the top (for bubble generation) and the bottom (for air flow) in the exemplified embodiment, although the bottom could be closed in other embodiments and openings could be formed into the body of the first housing assembly 200 for air flow purposes.

The second housing assembly 300 contains all of the electronic circuitry required for operation of the apparatus 100. Thus, for example, the second housing assembly 300 comprises an interior cavity 310 within which is located a power source 301 and a motor 302, which are operably coupled together. Any other electronic devices that form a part of the apparatus 100 could also be included in the interior cavity 310 of the second housing assembly 300. In certain embodiments, the interior cavity 310 is a hermetically sealed cavity such that liquid cannot penetrate the second housing assembly 300 and enter the interior cavity 310. This may be desirable to protect the electronic components that are located within the interior cavity 310 of the second housing assembly 300 from being damaged by liquids such as water during washing of the second housing assembly 300. Thus, in some embodiments the apparatus 100 may include a processor and/or memory device, and in such embodiments those components could be located in the interior cavity 310 of the second housing assembly 310.

The motor 302 and the power source 301 are operably coupled together so that power from the power source 301 may be provided to the motor 302 so that the motor 302 can be made to rotate. The second housing assembly 300 also includes an actuator 309, which in the exemplified embodiment is a button that protrudes from the outer surface of the second housing assembly 300. Of course, the actuator 309 need not be a button in all embodiments, but could be a toggle switch, a slide switch, a touch sensor, an inductive switch, or the like. Activation of the actuator 309 closes a circuit between the power source 301 and the motor 302 to enable power from the power source 301 to be transmitted to the motor 302. Thus, a first activation of the actuator 309 causes the motor 302 to rotate as described herein and a second activation of the actuator 309 will power the motor off.

The motor 302 comprises a drive shaft 303 that protrudes from the second housing assembly 300. Furthermore, a coupler 304 having a non-circular transverse cross-sectional shape is coupled to the drive shaft 303. The coupler 304 is entirely exposed and visible when the first housing assembly 200 is detached from the drip tray 400. However, by coupling the first housing assembly 200 to the drip tray 400, the coupler 304 interacts with a first coupler 212 of the fan device 210 to operably couple the motor 302 to the fan device 210. In the exemplified embodiment, the first coupler 212 of the fan device 210 is a recess that receives the coupler 304 that is attached to the drive shaft 303 of the motor 302. However, the specific structural details of the first coupler 212 of the fan device 210 and the coupler 304 attached to the drive shaft 303 of the motor 302 are not to be limiting of the present invention and they can take on any shape so long as they mate/interact to transmit rotation of the motor 302 to the fan device 210. In the exemplified embodiment, the recess of the first coupler 212 and the coupler 304 have non-circular transverse cross-sectional shapes so that rotation of the coupler 304 is imparted to the fan device 210 so that as the motor 302 rotates, so too does the fan device 210. Because there are no gears between the motor 302 and the fan device 210, in the exemplified embodiment the fan device 210 rotates at the same speed as the motor 302, although this is not required in all embodiments and gears or the like could be included to decrease and/or increase the rotational speed of the fan device 210.

The drip tray 400 is an open-top container having a collection reservoir 410 for collecting bubble solution that drips downwardly through the first housing assembly 200. The drip tray 400 is essentially a cup having a floor 402 and a sidewall 403 that define the collection reservoir 410 so that the drip tray 400 can collect any bubble solution that drips downwardly within the apparatus 100. The drip tray 400 has a pour spout 401 to facilitate pouring any bubble solution collected in the collection reservoir 401 back into a bottle of bubble solution or elsewhere as may be desired.

Referring to FIG. 2, when the apparatus 100 is fully assembled as shown, the drip tray 400 is positioned atop of the second housing assembly 300 and the first housing assembly 200 is positioned atop of the drip tray 400. Thus, in the assembled apparatus 100, the drip tray 400 is located axially in between the first and second housing assemblies 200, 300 such that the first and second housing assemblies 200, 300 are at least partially spaced apart in the axial direction by the drip tray 400. Furthermore, when the apparatus 100 is assembled the power source 301 is operably coupled to the motor 302 and the motor 302 is operably coupled to the fan device 210 and to the bubble solution dispenser 250. More specifically, the motor 302 is operably coupled to the fan device 210 and then the fan device 210 is operably coupled to the bubble solution dispenser 250 via the gear assembly 230 such that the motor 302 is indirectly operably coupled to the bubble solution dispenser 250. Thus, in operation when the actuator 302 is activated and the apparatus 100 is powered on, the motor 302 rotates about a rotational axis R1-R1, which also results in the fan device 210 and the bubble solution dispenser 250 rotating about the rotational axis R1-R1. Because the fan device 200 is directly coupled to the motor 302, the fan device 200 will rotate at the same rotational velocity (rotations per minute) as the motor 302. However, the gear assembly 230 is designed to slow down the rotational speed of the bubble solution dispenser 250 relative to the fan device 210 and to the motor 302. Thus, the bubble solution dispenser 250 rotates at a rotational velocity (rotations per minute) that is less than the rotational velocity of the fan device 210 and the motor 302.

Figure 4:
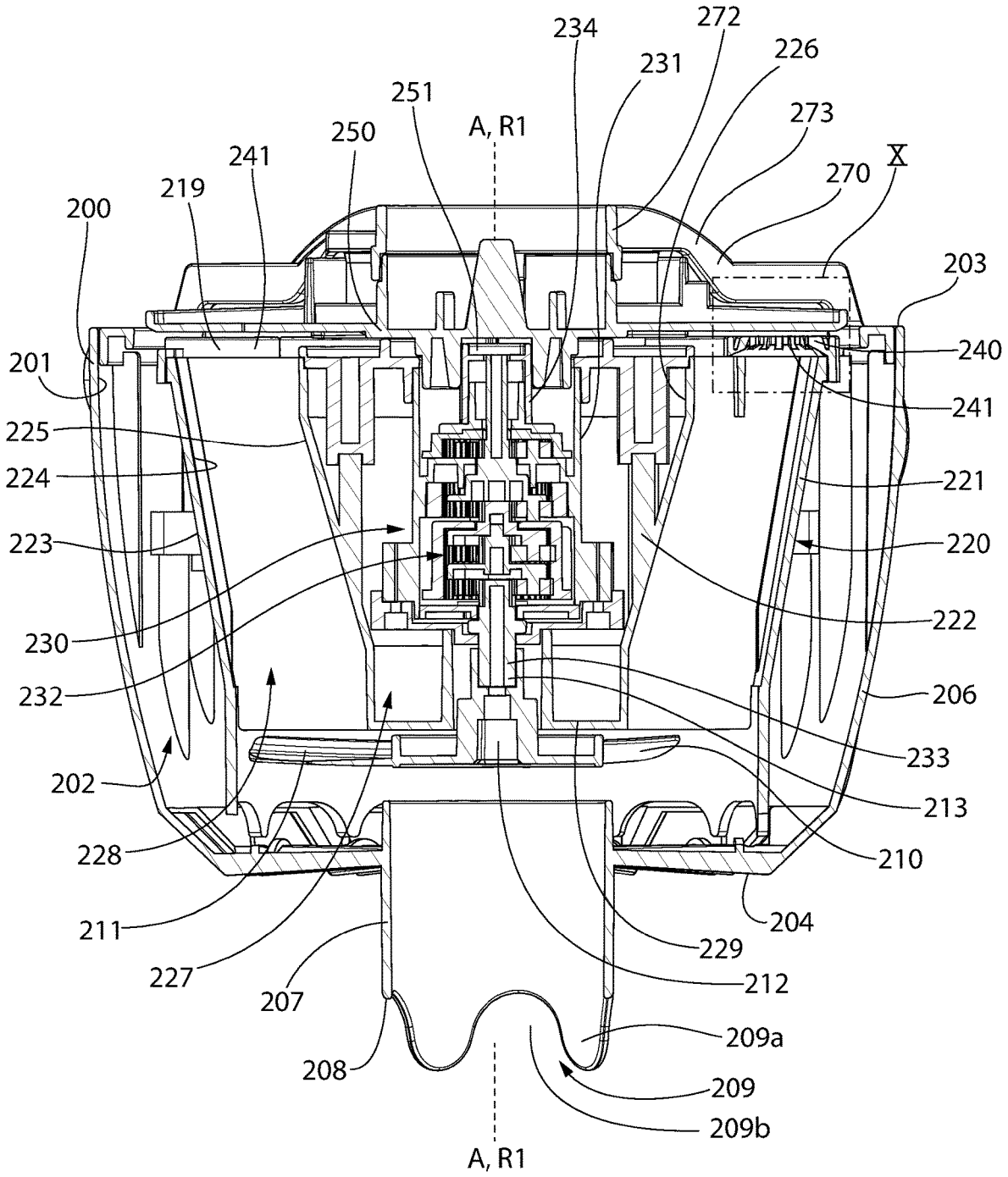
FIG. 4 illustrates a first housing assembly of the apparatus from the cross-sectional view of FIG. 2.

Referring to FIG. 4, the first housing assembly 200 is illustrated in cross-section. The first housing assembly 200 has a main body 206 that extends from a top end 203 to a bottom end 204 along a longitudinal axis A-A. In certain embodiments, the longitudinal axis A-A and the rotational axis R1-R1 may be the same axis. Furthermore, the longitudinal axis A-A of the first housing assembly 200 is also the longitudinal axis of the apparatus 100 when assembled. The main body 206 of the first housing assembly 200 has an outer surface 205 that is opposite the inner surface 201. The first housing assembly 200 also comprises a connection post 207 extending from the bottom end 204 of the main body 206 to a distal end 208. In the exemplified embodiment, the connection post 207 is a hollow cylindrical post having a circular transverse cross-sectional shape extending from the bottom end 204 of the main body 206. Of course, the invention is not to be so limited and in other embodiments the connection post 207 could be a solid structure and it could have other transverse cross-sectional shapes, such as being square, rectangular, triangular, or the like.

The connection post 207 of the first housing assembly 200 comprises an alignment feature 209. In the exemplified embodiment, the alignment feature 209 is formed at the distal end 208 of the connection post 207. Specifically, the distal end 209 of the connection post 207 comprises an undulating edge comprising a series of circumferentially adjacent protrusions 209*a* and recesses 209*b*. The undulating edge of the distal end 209 is intended to mate with an alignment feature of the drip tray 400 to facilitate proper alignment between the first housing assembly 200 and the drip tray 400 when those components are coupled together. The alignment features 209*a*, 209*b* of the first housing assembly 200 and the drip tray 400 are also intended to prevent the first housing assembly 200 from rotating relative to the drip tray 400 during operation of the apparatus 100. Of course, the alignment feature 209 can take on other shapes, structures, or the like so long as it is configured to mate with an alignment feature of the drip tray 400 as described herein.

Although the alignment feature 209 is depicted as being formed by the distal end 208 of the connection post 207, the invention is not to be so limited in all embodiments. In other embodiments, the alignment feature 209 may be one or more notches, protuberances, recesses, springs, clips, or the like located on an outer surface or an inner surface of the connection post 207. The alignment feature 209 can take on other structural forms and be positioned at other locations along the connection post 207 so long as it is configured to mate with an alignment feature of the drip tray 400 (described below with reference to FIGS. 13 and 14). Of course, in some embodiments the alignment feature 209 may be omitted without affecting the ability to detachably couple the first housing assembly 200 to the drip tray 400. However, the alignment feature 209 may make the coupling between the first housing assembly 200 and the drip tray 400 more stable than it would be without the alignment feature 209. Specifically, in some embodiments particularly where the connection post 207 has a circular transverse cross-sectional shape, the first housing assembly 200 may be able to freely rotate relative to the drip tray 400 if the alignment feature 209 were to be omitted. The alignment feature 209 could be formed by having the connection post 207 have a non-circular transverse cross-sectional shape as this would also facilitate the described alignment.

As noted previously, the fan device 210 is positioned within the interior space 202 of the first housing assembly 200. The fan device 210 is not limited to being a fan in all embodiments, but can be any device that is configured to generate an air stream when it is powered on. Thus, the fan device 210 may be any type of air generator, air flow generator, air stream generator, or the like. In the exemplified embodiment, the fan device 210 comprises a plurality of circumferentially spaced apart blades 211 that are oriented so that when the fan device 210 is rotated in a particular direction (one of clockwise or counterclockwise), the air stream generated by the fan device 210 flows upwardly towards the top end 203 of the first housing assembly 200.

Figure 5A:
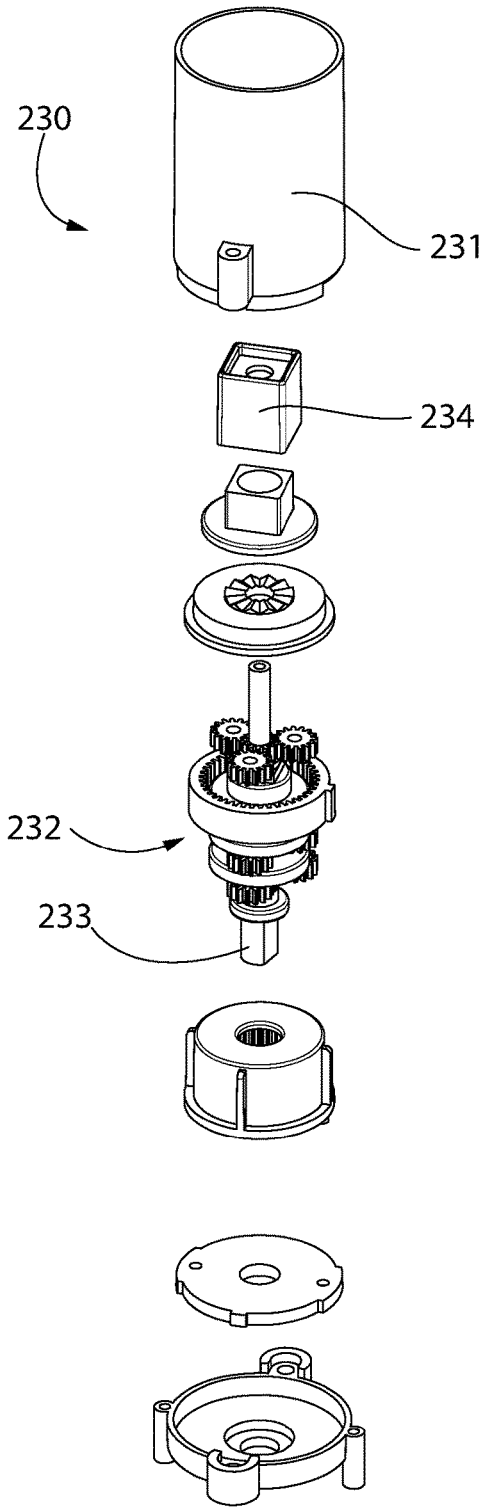
FIGS. 5A and 5B are exploded views of a gear assembly of the apparatus of FIG. 1.
Figure 5B:
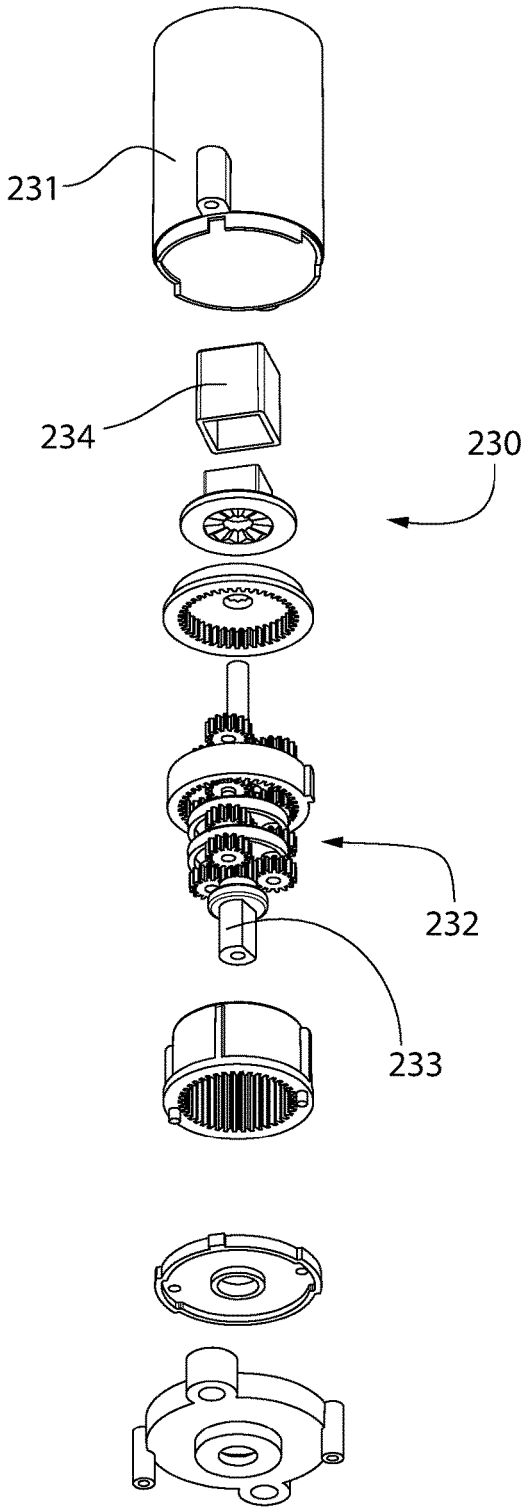

Referring to FIGS. 4, 5A, and 5B the gear assembly 230 will be further described. The gear assembly 230 generally comprises a sleeve 231, a gear train 232 housed within the sleeve 231, a first gear coupler 233 for coupling the gear assembly 230 to the fan device 210, and a second gear coupler 234 for coupling the gear assembly 230 to the bubble solution dispenser 250. The gear train 232 operates as a speed reducer, which means that the output gear (the gear furthest from the motor 302) rotates more slowly than the input gear (the gear closest to the motor 302). The input gear is operably coupled to the fan device 210 and the output gear is operably coupled to the bubble solution dispenser 250. Thus, the purpose of the gear train 232 is to allow the motor 302 to simultaneously control operation/rotation of the fan device 210 and the bubble solution dispenser 250 while rotating the bubble solution dispenser 250 at a slower rotational speed/velocity than the fan device 210.

When the gear assembly 230 is assembled as shown in FIGS. 3 and 4, the first gear coupler 233 protrudes from a bottom end of the sleeve 231 and the second gear coupler 234 protrudes from a top end of the sleeve 231. Each of the first and second gear couplers 233, 234 has a non-circular transverse cross-sectional shape. In the exemplified embodiment, the first gear coupler 233 has a truncated circle transverse cross-sectional shape and the second gear coupler 234 has a square/rectangular transverse cross-sectional shape. However, any transverse cross-sectional shape may be used so long as it is not circular and it corresponds with a shape of a recess in the fan device 210 and the bubble solution dispenser 250 to which it is coupled.

In the exemplified embodiment, the fan device 210 has the first coupler 212 configured to couple the fan device 210 to the motor 302 as described above and a second coupler 213 configured to couple the fan device to the first gear coupler 233 of the gear assembly 230. In the exemplified embodiment, the second coupler 213 of the fan device 210 is a recess that is configured to receive the first gear coupler 233 of the gear assembly 230. However, the invention is not to be so limited in all embodiments and in other embodiments the first gear coupler 233 could be a recess while the second coupler 213 of the fan device 210 could be a post or protuberance or the like that is received in the recess. Furthermore, in the exemplified embodiment the bubble solution dispenser 250 has a coupler 251, which in the exemplified embodiment is a recess configured to receive the second gear coupler 234 of the gear assembly 230. Of course, the coupler 251 of the bubble solution dispenser 250 could be a post while the second gear coupler 234 is a recess in other embodiments.

Referring again to FIG. 4, the fan device 210 is held in place within the interior space 202 of the first housing assembly 200 due to its coupling to the first gear coupler 233 of the gear assembly 230. Specifically, the second coupler 213 of the fan device 210 comprises a recess having a shape that corresponds with the shape of the first gear coupler 233 of the gear assembly 230 so that the first gear coupler 233 of the gear assembly 230 can be received within the recess of the second coupler 213 of the fan device 210. The non-circular transverse cross-sectional shapes of the first gear coupler 233 of the gear assembly 230 and the second coupler 213 of the fan device 210 ensure that as the fan device 210 rotates due to its coupling to the motor 302, so too does the first gear coupler 233 of the gear assembly 230, which in turn rotates the gears of the gear train 232, which in turn rotates the second gear coupler 234 of the gear assembly 230, which in turn rotates the bubble solution dispenser 250.

The outer container 221 and the inner funnel 222 of the air guide 220 are also located within the interior space 202 of the first housing assembly 200. The outer container 221 is coupled to the first housing assembly 200 and the inner funnel 222 is coupled to the outer container 221. The outer container 221 has an outer surface 223 that faces the inner surface 201 of the first housing assembly 200 and an opposite inner surface 224. The inner funnel 222 has an outer surface 225 that faces the inner surface 224 of the outer container 221 and an opposite inner surface 226. The inner surface 226 of the inner funnel 222 defines a cavity 227 within which the gear assembly 230 is positioned. Furthermore, although the outer container 221 and the inner funnel 222 of the air guide 220 are coupled together, portions of the inner surface 224 of the outer container 221 and the outer surface 225 of the inner funnel 222 are spaced apart from one another, thereby defining an air passageway 228 between the inner surface 224 of the outer container 221 and the outer surface 225 of the inner funnel 222. In the exemplified embodiment, the inner funnel 222 has radial fins that extend into the air passageway 228 between the inner funnel 222 and the outer container 221. In certain embodiments, the radial fins of the inner funnel 222 may be received within slots of the outer container 221 for coupling of the inner funnel 222 to the outer container 221.

The inner funnel 222 of the air guide 220 has a floor 229 that is positioned adjacent to the fan device 210, thereby preventing the air stream generated by the fan device 210 when the fan device 210 is rotated by the motor 302 from entering the cavity 227 defined by the inner funnel 222 of the air guide 220. Instead, all of the air generated by the fan device 210 is required to flow through the air passageway 228 defined between the outer container 221 and the inner funnel 222 of the air guide 220. The air passageway 228 thereby guides the air stream generated by the fan device 210 from the fan device 210 to one or more bubble generating devices 241 of the bubble generating assembly 240, which are aligned with the air passageway 228.

The air passageway 228 is an annular passageway located within the first housing assembly 200 that surrounds the longitudinal axis A-A of the first housing assembly 200. Furthermore, the air passageway 228 is shaped so as to diverge as it extends from the fan device 210 towards the top end 203 of the first housing assembly 200. Thus, the air passageway 228, for at least a portion of its length measured between the fan device 210 and the top end 203 of the first housing assembly 200, extends at an oblique angle relative to the longitudinal axis A-A of the first housing assembly 200 in a direction away from the longitudinal axis A-A of the first housing assembly 200 when moving in a direction from the fan device 210 towards the top end 203 of the first housing assembly 200. The air passageway 228 has an annular top end 219 that surrounds the bubble solution dispenser 250. The bubble generating devices 241 of the bubble generating assembly 240 are arranged in a spaced apart manner adjacent to the annular top end 219 of the air passageway 228 so that the air stream generated by the fan device 210 passes through the bubble generating devices 241, which generates bubbles when those bubble generating devices 241 are loaded with a bubble solution as described herein.

Figure 6:
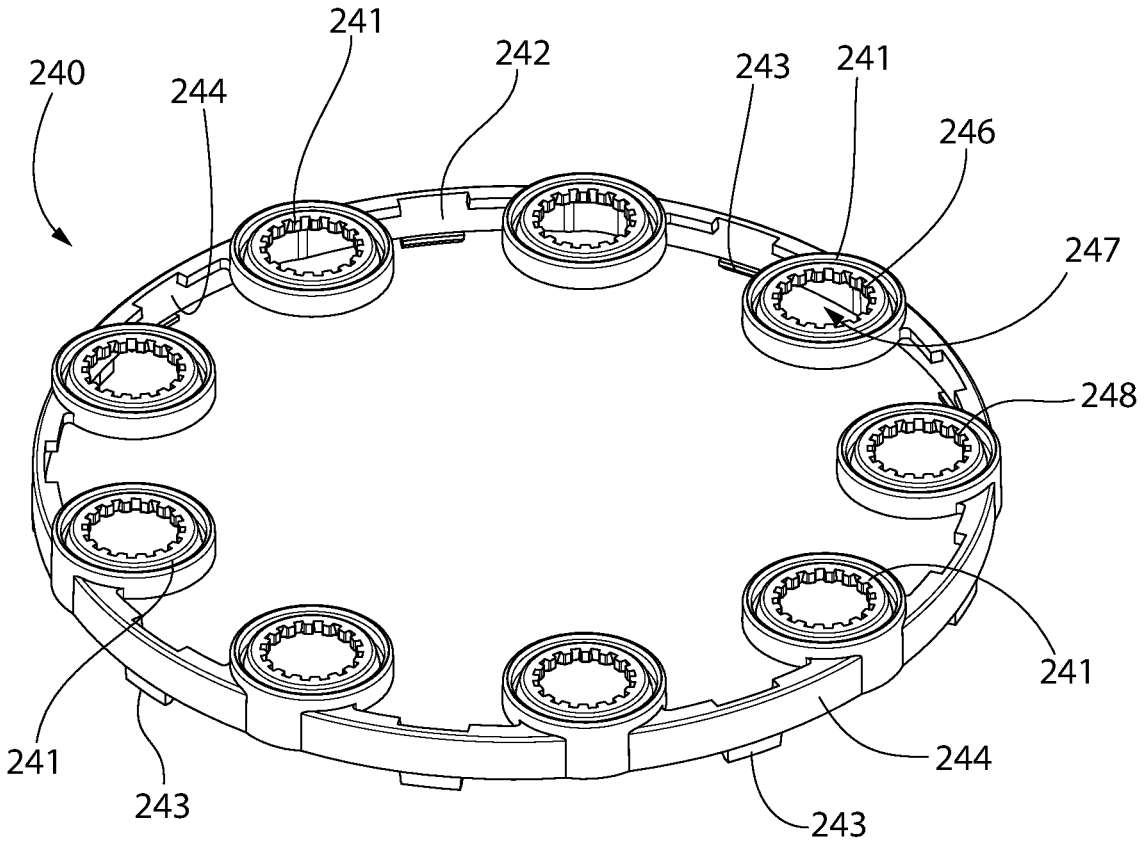
FIG. 6 is a perspective view of a bubble generating assembly of the apparatus of FIG. 1.

Referring to FIGS. 4 and 6 concurrently, the bubble generating assembly 240 and the manner in which it is coupled to the first housing assembly 200 (indirectly in the exemplified embodiment, although a direct coupling could be used in other embodiments) will be described. In the exemplified embodiment, the bubble generating assembly 240 comprises a ring structure 242 and a plurality of the bubble generating devices 241 extending from the ring structure 242 in a spaced apart manner. Specifically, in the exemplified embodiment the ring structure 232 has an inner surface 244 and an outer surface 245, and each of the bubble generating devices 241 extends radially from the inner surface 244 of the ring structure 232 towards a center point of the ring structure 242.

Each of the bubble generating devices 241 is an annular-shaped structure having an inner surface 246 that surrounds a central aperture 247. Furthermore, the bubble generating devices 241 comprise a plurality of ribs or ridges 248 protruding from the inner surface 246 in a spaced apart manner. The ridges 248 assist in loading bubble solution onto the bubble generating devices 241. Specifically, when a bubble solution is dripped onto the bubble generating devices 241 or the bubble generating devices 241 are dipped into a reservoir of bubble solution, the bubble solution adheres to the bubble generating devices 241 along the ridges 248 on the inner surface 246. The bubble solution will then extend across the central aperture 247, thereby forming a film of the bubble solution that fills in the space defined by the inner surface 246 of the bubble generating devices 241. When the bubble solution adheres to the bubble generating devices 241, those bubble generating devices 241 are considered to be loaded with the bubble solution.

The bubble generating assembly 240 also comprises a plurality of clip members 243 extending from a lower surface of the ring structure 232. The clip members 243 are resilient relative to the ring structure 232 such that the clip members 243 can flex/move relative to the ring structure 232 to facilitate coupling of the bubble generating assembly 240 to the first housing assembly 200. In the exemplified embodiment, the bubble generating assembly 240 is coupled directly to the outer container 221 of the air guide 220. Thus, the clip members 243 interact with the outer container 221 to couple the bubble generating assembly 240 to the outer container 221. However, this is not required in all embodiments and the bubble generating assembly 240 could be coupled to the first housing assembly 200 directly or to other components thereof so long as the bubble generating devices 241 are positioned so as to be in alignment with the air stream generated by the fan device 210 when the apparatus 100 is operating. When the air generating assembly 240 is coupled to the housing assembly 200, the bubble generating devices 241 are positioned in a spaced apart manner in alignment with the air passageway 228, and hence also with any air stream generated by the fan device 210.

The bubble generating assembly 240 is coupled to the first housing assembly 200, either directly or indirectly (such as by a direct coupling to the outer container 221, which in turn is coupled directly to the first housing assembly 200) so that the bubble generating assembly 240 is in a fixed position relative to the first housing assembly 200. Thus, in the exemplified embodiment, the bubble generating assembly 240 is not intended to rotate or otherwise move relative to the first housing assembly 200. Each of the bubble generating devices 241 is in a fixed position and the bubble generating assembly 240 and the bubble generating devices 241 thereof are static. During operation of the apparatus 100, which will be described in greater detail below, the fan device 210 and the bubble solution dispenser 250 rotate about the rotational axis R1-R1, but the bubble generating assembly 240 and its bubble generating devices 241 are static and do not move relative to the first housing assembly 200. Thus, the bubble generating assembly 240 is non-rotatable relative to the first housing assembly 200.

In the exemplified embodiment, the bubble generating assembly 240 is a monolithic component formed out of a hard plastic material during an injection molding process. Of course, the invention is not to be so limited in all embodiments. The ring structure 242 could be separately formed from and later coupled to the bubble generating devices 241 in some embodiments. In other embodiments, the ring structure 242 could be omitted and the bubble generating devices 241 could be formed as an integral structure (by having them attached to one another) or formed separately and then separately coupled to the first housing assembly 200. Furthermore, in the exemplified embodiment there are nine of the bubble generating devices 241. However, the invention is not to be limited by the specific number of bubble generating devices 241. Thus, in some embodiments the bubble generating assembly 240 may include only one bubble generating device 241 or it could include any number of bubble generating devices 241. In the exemplified embodiment, the bubble generating devices 241 are each spaced apart from one another. In other embodiments, the bubble generating devices 241 could each be attached to the bubble generating devices 241 adjacent thereto (i.e., each bubble generating device 241 could be attached to two other bubble generating devices 241). This could result in many more bubble generating devices 241 being positioned in alignment with the air stream, which would result in the formation/generation of more bubbles during operation. However, spacing between the bubble generating devices 241 may be desirable in some embodiments to prevent the bubbles from clinging to one another as they float away from the apparatus 100.

Figure 7A:
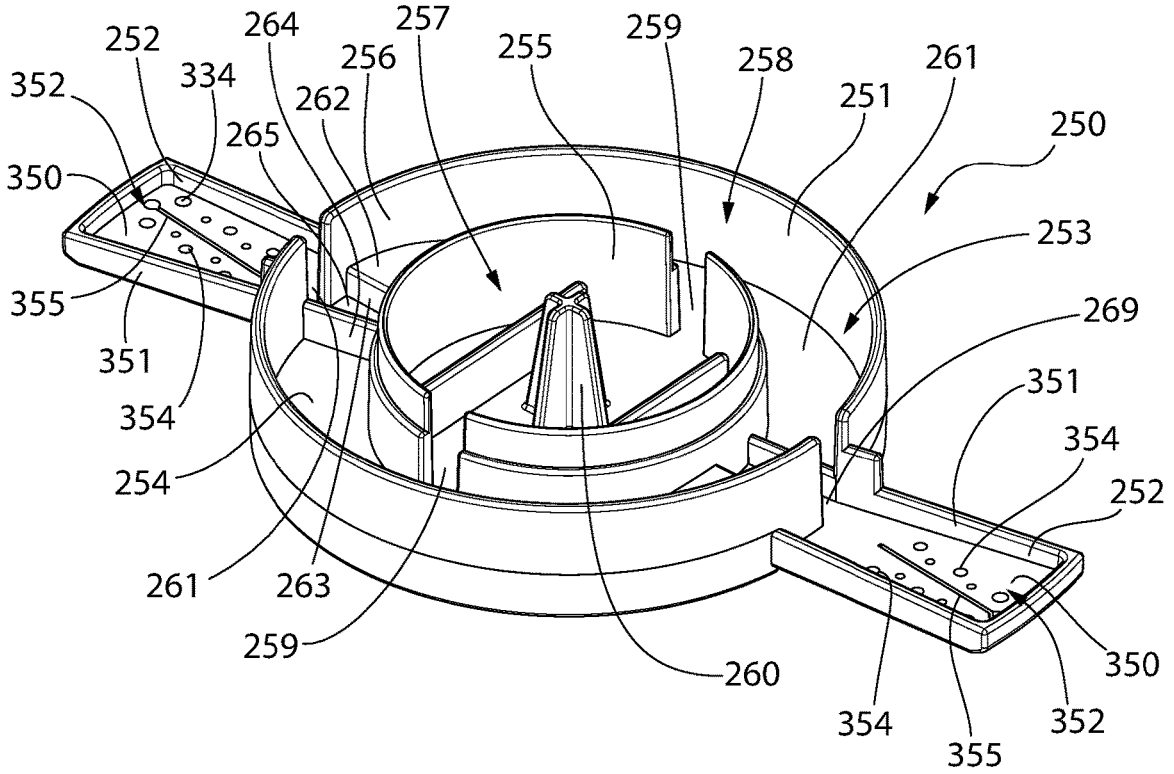
FIGS. 7A and 7B are top and bottom perspective views of a bubble solution dispenser of the apparatus of FIG. 1.
Figure 7B:
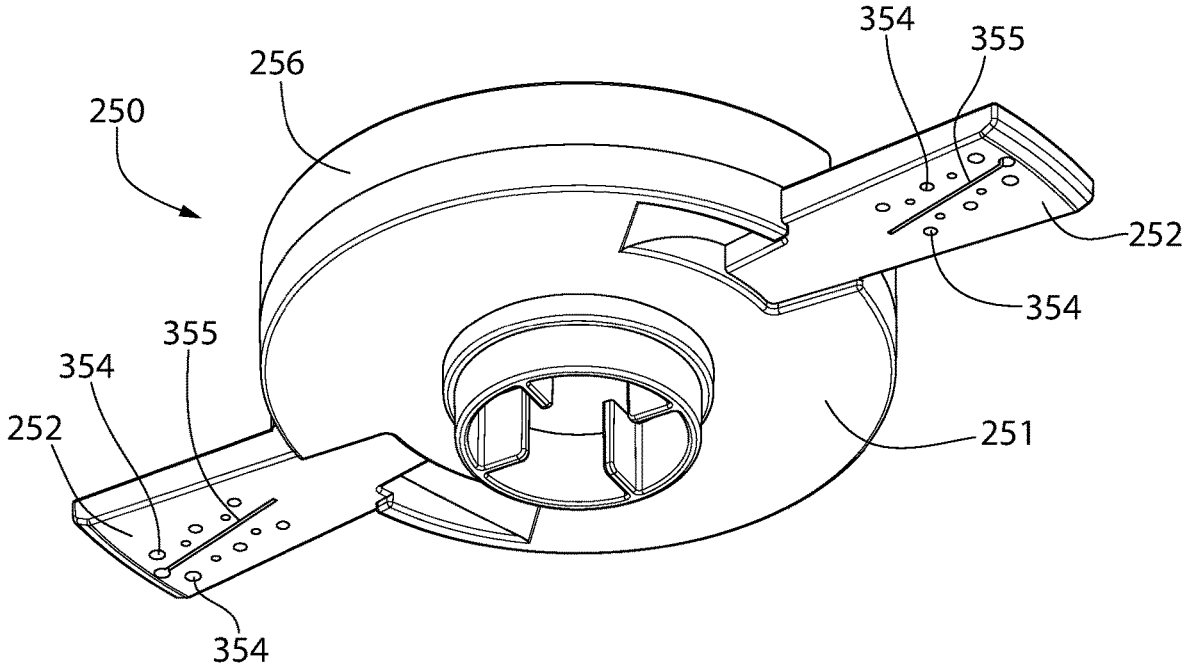

Referring to FIGS. 4, 7A, and 7B concurrently, the bubble solution dispenser 250 and the manner in which it is coupled to the first housing assembly 200 will be described. The bubble solution dispenser 250 may be referred to herein as a skinner or a skinner member because it cause a film of the bubble solution to be formed on the bubble generating devices 241 as is passes across the bubble generating devices 241. The bubble solution dispenser 250 comprises a hub portion 251 and at least one delivery member 252 extending from the hub portion 251. In the exemplified embodiment, there are two of the delivery members 252 extending from the hub portion 251, but in other embodiments there could be just one of the delivery members 252 or there could be more than two of the delivery members 252. In the exemplified embodiment, the two delivery members 252 extend radially from the hub portion 251 and are circumferentially spaced apart by between 80° and 100°, although different spacing may be possible in other embodiments. The delivery members 252 extend radially from the hub portion 251 and are used to dispense the bubble solution onto the bubble generating devices 241 as described herein. Specifically, in the exemplified embodiment, as the bubble solution dispenser 250 rotates about the rotational axis R1-R1, the bubble solution dispenser 250 dispenses the bubble solution onto the bubble generating devices 241, which are static or non-moving relative to the first housing assembly 200.

The hub portion 251 of the bubble solution dispenser 250 comprises a storage reservoir 253 that, during operation, contains a supply of the bubble solution. More specifically, the hub portion 251 comprises a floor 254, a first annular sidewall 255 extending from the floor 254, and a second annular sidewall 256 extending from the floor 254. The second annular sidewall 256 generally surrounds the first annular sidewall 255 in a concentric manner. A first portion 257 of the storage reservoir 253 is formed by the floor 254 and inner surface of the first annular sidewall 255. A second portion 258 of the storage reservoir 253 is formed by the floor 254, an outer surface of the first annular sidewall 255, and an inner surface of the second annular sidewall 256. An opening 259 is formed into the first annular sidewall 255 to fluidly couple the first and second portions 257, 258 of the storage reservoir 253 together. Thus, bubble solution in the first portion 257 of the storage reservoir 253 is capable of flowing to the second portion 258 of the storage reservoir 253 through the openings 259, and vice versa.

The first annular sidewall 255 forms a portion of a bubble solution bottle support member. Specifically, a bubble solution bottle can be placed upside down with its opening facing the first portion 257 of the storage reservoir 253 and the first annular sidewall 255 (along with the support member 270 as described in more detail below) can hold the bubble solution bottle in the upside-down orientation. Thus, bubble solution can readily flow out of the bubble solution bottle into the first portion 257 of the storage reservoir 253 and from the first portion 257 of the storage reservoir 253 to the second portion 258 of the storage reservoir 253 via the openings 259. This can all occur passively without user intervention. The bubble solution dispenser 250 also has a post 260 protruding from the floor 254 within the first portion 257 of the storage reservoir 253 for guiding the flow of the bubble solution from the bubble solution bottle into the first portion 257 of the storage reservoir 253.

The delivery member 252 of the bubble solution dispenser 250 comprises a floor 350 and a sidewall 351 extending upwardly from the floor 351. The floor 350 and the sidewall 351 collectively define a delivery reservoir 352 of the bubble solution dispenser 250. However, it should be appreciated that the sidewall 351 could be omitted in alternative embodiments and the delivery reservoir 352 could be defined solely by the floor 350. That is, the bubble solution can be held on the floor 350 for dispensing onto the bubble generating devices 241 even without the sidewall 351 being present. In the exemplified embodiment, there is at least one aperture 354 formed into the floor 350 so that any bubble solution that is located in the delivery reservoir 352 can flow downwardly through the aperture 354 via gravity for dispensing onto the bubble generating assembly 240, as described in more detail below. In the exemplified embodiment, there are a plurality of the apertures 354 formed into the floor 350 of the delivery member 252. The apertures 354 comprise at least one slot 355 and a plurality of apertures 354 located on opposite sides of the slot 355. The at least one slot 355 may have a length measured from end-to-end that is equal to or greater than a diameter of each of the bubble generating devices 241 of the bubble generating assembly 240. Of course, the specific pattern/arrangement of the apertures 354 is not to be limiting of the present invention and other patterns, arrangements, numbers of apertures, or the like may be used in other embodiments.

Although in the exemplified embodiment the apertures 354 are illustrated and described for delivering the bubble solution from the delivery reservoir 352 to the bubble generating devices 241, the invention is not to be so limited in all embodiments. In other embodiments, the sidewall 351 of the delivery member 252 may have one or more openings therein so that the bubble solution can flow out of the delivery reservoir 352 and onto the bubble generating devices 241. In other embodiments as noted above, the sidewall 351 may be omitted and thus the bubble solution may be delivered by simply flowing past the boundaries of the floor 350. In still other embodiments, the bubble generating devices 241 may be dipped into the delivery reservoir 352 for delivering the bubble solution to the bubble generating devices 241. Thus, alternative ways for delivering the bubble solution to the bubble generating devices 241 may be possible within the scope of the invention described herein.

In the exemplified embodiment, the bubble solution dispenser 250 is positioned so that the delivery member 252 passes over the top of the bubble generating devices 241 during use. As a result, the bubble solution drips/falls through the apertures 354 for loading the bubble generating devices 241 with the bubble solution. However, the invention is not to be so limited in all embodiments. For example, in some alternative embodiments the bubble solution dispenser 250 may be positioned so that the delivery member 252 passes below the bottom of the bubble generating devices 241 (i.e., at a location between the bubble generating devices 241 and the fan device 210). In such an embodiment, the bubble generating devices 241 may contact the bubble solution in the delivery member 252 as the delivery member 252 rotates or otherwise moves due to its operable coupling to the motor 302 as described herein.

The second annular sidewall 256 has openings 269 that fluidly couple the second portion 258 of the storage reservoir 253 with the delivery reservoir 352 of the delivery member 252. Thus, the bubble solution can flow from the second portion 258 of the storage reservoir 253 of the hub portion 251 of the bubble solution dispenser 250 to the delivery reservoir 352 of the delivery member 252 of the bubble solution dispenser 250 via the openings 269 in the second annular sidewall 256. In the exemplified embodiment, the delivery member 252 is circumferentially offset from the opening 259 in the first annular sidewall 255 and circumferentially aligned with the opening 269 in the second annular sidewall 256. Thus, the fluid can't flow directly through the openings 259 and the openings 269, but instead must flow through the openings 259, then circumferentially along the second portion 258 of the storage reservoir 253 to the openings 269, and from there into the delivery reservoir 352.

Referring to FIGS. 7A, 8, 9, and 19A, the floor 254 of the second portion 258 of the storage reservoir 253 will be described. The floor 254 of the second portion 258 of the storage reservoir 253 comprises a first circumferential portion 261 and a second circumferential portion 262. In the exemplified embodiment, there are two of the first circumferential portions 261 and two of the second circumferential portions 262, although this can be modified to be one of each or more than two of each without affecting the overall functionality of the apparatus 100.

The second circumferential portion 262 extends from the first circumferential portion 261 to a terminal end 263. In the exemplified embodiment, the first circumferential portion 261 is flat, or oriented along a horizontal plane, whereas the second circumferential portion 262 forms a ramp such that the second circumferential portion 262 is inclined relative to the first circumferential portion 261. The terminal end 263 of the second circumferential portion 262 is elevated relative to the end of the second circumferential portion 262 that is immediately adjacent to the first circumferential portion 261. Thus, the second circumferential portion 262 forms a ramp having an upward incline as it extends from the first circumferential portion 261 to the terminal end 263.

The bubble solution dispenser 250 comprises a stopper wall 264 extending upwardly from the floor 254 along the second portion 258 of the storage reservoir 253. As a result, a dispensing portion 265 of the storage reservoir 253 is defined between the stopper wall 264 and the terminal end 263 of the second circumferential portion 262. The dispensing portion 265 of the storage reservoir 253 is aligned with the openings 269 in the second annular sidewall 256. Thus, the bubble solution within the dispensing portion 265 of the storage reservoir 253 readily flows through the opening 269 to the delivery reservoir 352.

Figure 19A:
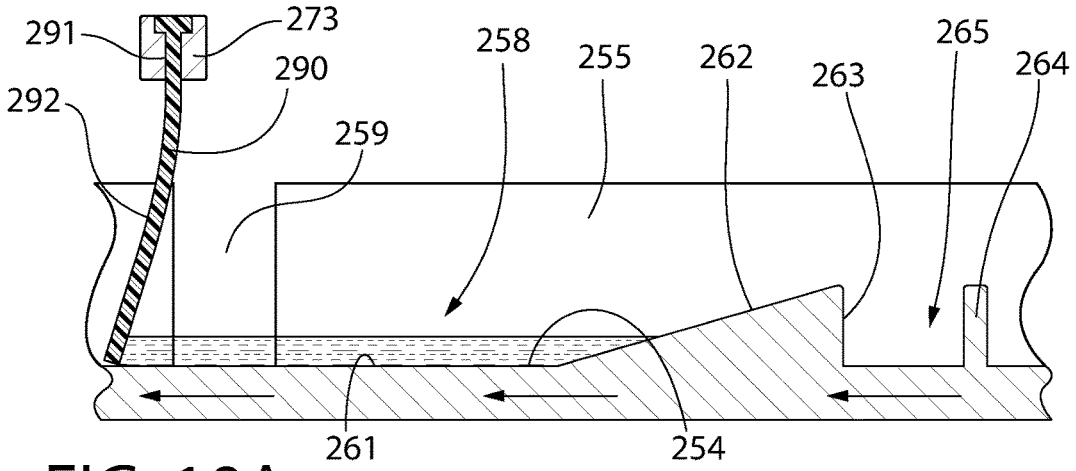
FIGS. 19A-19C are schematic cross-sectional views of a portion of the apparatus to show the manner in which the bubble solution is moved from a storage position to a dispensing position during operation.

Because the second circumferential portion 262 of the floor 254 of the second portion 258 of the storage reservoir 253 is oriented at an incline, in some embodiments the bubble solution may not be able to readily flow up the second circumferential portion 262 and into the dispensing portion 265 of the storage reservoir 253. Specifically, as best shown in FIG. 19A, in some embodiments the bubble solution may extend partway up the second circumferential portion 262 of the floor 254, but not all the way to the dispensing portion 265 of the storage reservoir 253. In such embodiments, the bubble solution may only be delivered to the delivery 352 when the bubble solution dispenser 250 is being moved by the motor 302.

For example, in some embodiments the paddles 290 will facilitate the movement of the bubble solution up the ramp of the second circumferential portion 262 and into the dispensing portion 265 of the storage reservoir 253 (see FIGS. 19A-19C, which will be described in greater detail below) when the bubble solution dispenser 250 is being moved by the motor 302. Thus, in the exemplified embodiment the bubble solution can only be delivered to the delivery reservoir 352 when the bubble solution dispenser 250 is being moved by the motor 302 (due to the paddles 290). This prevents the bubble solution from freely flowing into the assembly when operation is not desired because such free flow would simply result in the bubble solution flowing from the bottle of bubble solution directly into the drip tray 400. Thus, in some embodiments the bubble solution is prevented from flowing to the delivery reservoir 352 when the bubble solution dispenser 250 is not being moved/rotated by the motor 302.

Of course, in other embodiments the entirety of the floor 254 may be oriented along a horizontal plane rather than including the ramped portion as described herein. In such embodiments, paddles 290 that will be described below can be omitted because the bubble solution will be able to flow to the delivery reservoir 352 without being forced there by the paddles. In still other embodiments, the floor 254 along the second portion 258 of the storage reservoir 253 may be inclined downwardly from the opening 259 in the first annular sidewall 255 to the opening 269 in the second annular sidewall 256 to facilitate the desired flow of the bubble solution to the delivery reservoir 352. Thus, modifications are possible while still permitting the apparatus 100 to function as described herein.

Figure 8:
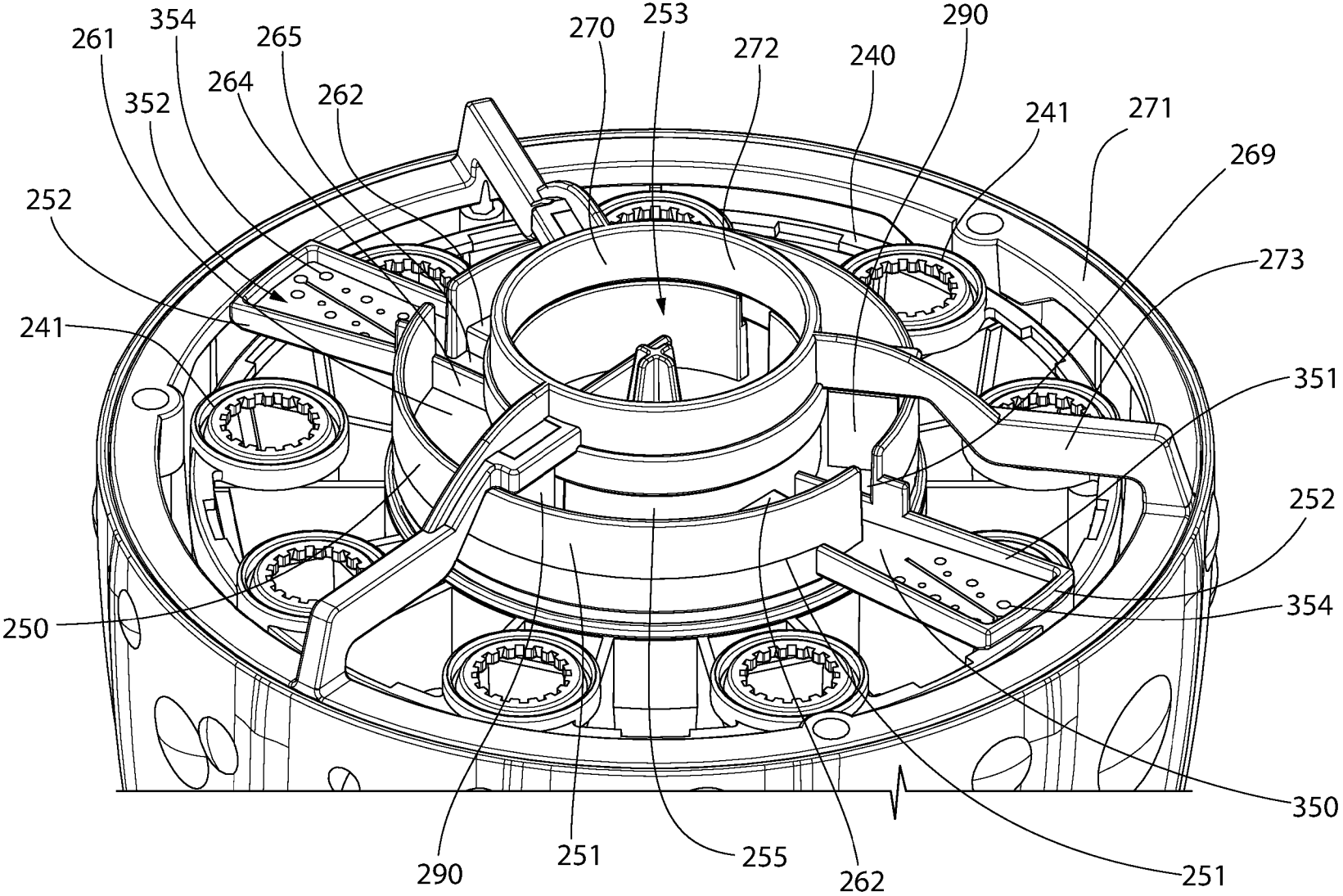
FIG. 8 is a close-up view of area XIII of FIG. 1.
Figure 9:
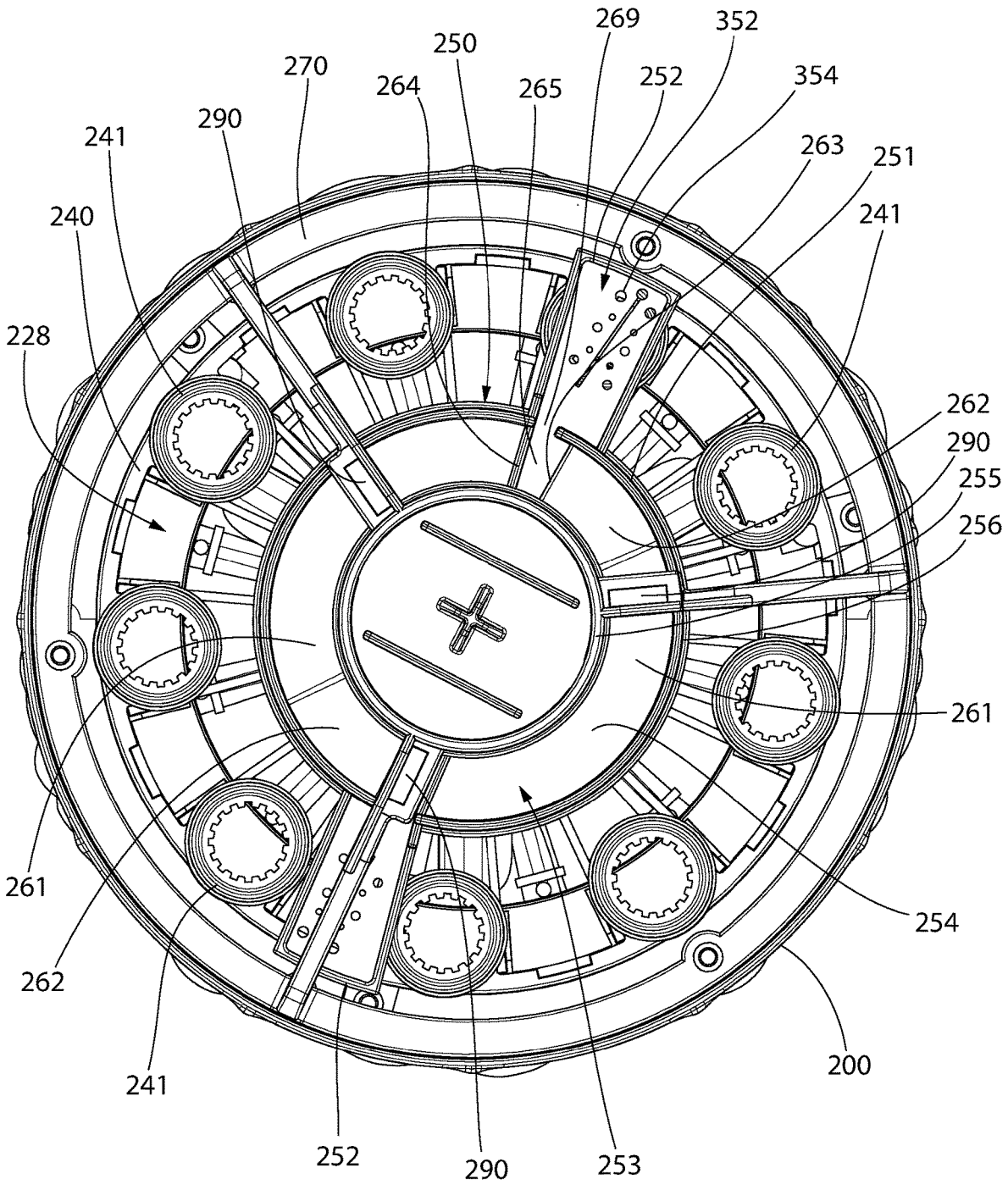
FIG. 9 is a top view of the apparatus of FIG. 1.
Figure 10:
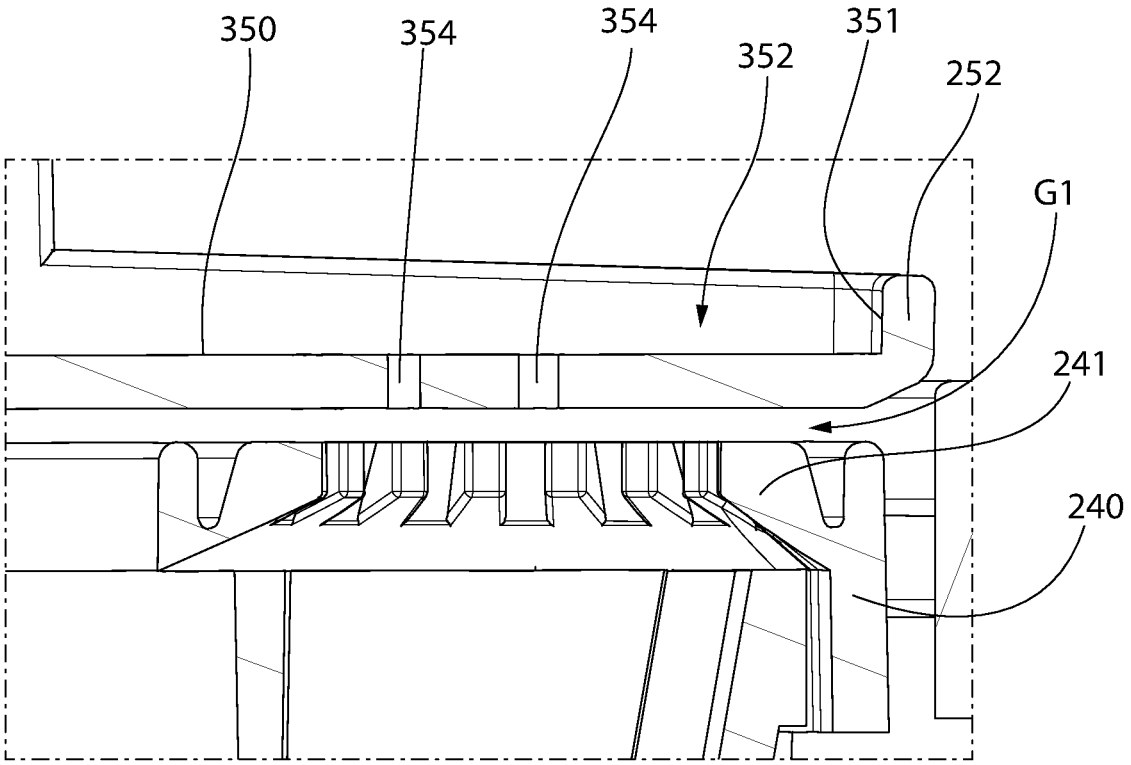
FIG. 10 is a close-up view of area X of FIG. 2.

Referring to FIGS. 4, 8, and 10, during operation of the apparatus 100, the motor 302 is operably coupled to the fan device 210 and to the bubble solution dispenser 250 as described herein above (due to the fan device 210 being coupled to the bubble solution dispenser 250 via the gear assembly 230). Thus, as the motor 302 rotates about the rotational axis R1-R1, so too does the fan device 210 and the bubble solution dispenser 250. In the exemplified embodiment, the bubble generating assembly 240 and each of the bubble generating devices 241 are fixed relative to the first housing assembly 200 such that the bubble generating assembly 240 and the bubble generating devices 241 are static relative to the first housing assembly 200 while the fan device 210 and the bubble solution dispenser 250 rotate about the rotational axis R1-R1.

In the exemplified embodiment, as the bubble solution dispenser 250 rotates, the delivery members 252 pass across the bubble generating devices 241 and the bubble solution located within the delivery reservoir 352 flows through the apertures 354 and drips onto the bubble generating devices 241 of the bubble generating assembly 240. In the exemplified embodiment, the delivery members 252 pass over the top of the bubble generating devices 241. However, as noted above in other embodiments the delivery members 252 may pass beneath the bubble generating devices 241 while still being configured to dispense the bubble solution thereto. Thus, stating that the delivery members 252 pass across the bubble generating devices 241 may include the delivery members 252 passing over the bubble generating devices 241 or under the bubble generating devices 241. In some embodiments where the delivery members 252 pass over the bubble generating devices 241, the delivery of the bubble solution from the delivery reservoir 352 to the bubble generating devices 241 occurs via gravity which allows the bubble solution to fall through the apertures 354. As the bubble solution dispenser 250 rotates about the rotational axis R1-R1, the delivery member 252 passes over each of the bubble generating devices 241 of the bubble generating assembly 240, allowing the bubble solution to drip onto the bubble generating devices 241 as the delivery member 252 passes over it.

As best seen in FIG. 10, in the exemplified embodiment the delivery member 252 is spaced apart from the bubble generating devices 241 as it passes across them. Thus, there is a gap G1 between the delivery member 252 and the bubble generating devices 241 as the delivery member 252 rotates and passes over the various bubble generating devices 241. Stated another way, in the exemplified embodiment the delivery member 252 does not make direct contact with the bubble generating devices 241 as the delivery member 252 passes over the bubble generating devices 241. Rather, the delivery member 252 merely passes over the bubble generating devices 241 while maintaining the gap G1 and allowing the bubble solution to drip through the apertures 354 to form a film of the bubble solution on the bubble generating devices 241. In alternative embodiments, it may be possible for this gap to be omitted so that the delivery member 252 directly contacts the bubble generating devices 241 to assist in delivery of the bubble solution thereto. This may be necessary in certain embodiments where the delivery member 252 passes beneath rather than over the bubble generating devices 241 to ensure that the bubble solution is properly and adequately delivered/loaded onto the bubble generating devices 241. As mentioned above, the bubble generating devices 241 are all positioned so as to be aligned with the air stream generated by the fan device 210. Thus, once the bubble generating devices 241 are loaded with the bubble solution and the air stream generated by the fan device 210 passes through the bubble generating devices 241, bubbles are formed.

Referring to FIGS. 4 and 8, the support member 270 will be described. The support member 270 comprises an outer ring structure 271 that is coupled to the first housing assembly 200, an inner ring structure 272 that is coupled to the first annular sidewall 255 of the hub portion 251 of the bubble solution dispenser 250, and a plurality of arm members 273 extending from the outer ring structure 271 to the inner ring structure 272. In the exemplified embodiment, the support member 270 is an integrally formed monolithic structure. The inner ring structure 272, either by itself or collectively with the first annular sidewall 255 of the hub portion 251 to which it is attached, forms a bottle support structure that is configured to support a bubble solution bottle in an upside-down orientation. Thus, a bubble solution bottle can be placed upside-down with the neck and dispensing opening located within the storage reservoir 253. The bubble solution will thereby flow out of the bubble solution bottle and into the storage reservoir 253 where it can be dispensed onto the bubble generating devices 241 as described herein. The inner ring structure 272, alone or in combination with the first annular sidewall 255, will hold the bubble solution bottle in place in the upside-down orientation. This way, the bubble solution can continue to be dispensed from the bubble solution bottle into the storage reservoir 253 during operation as more of the bubble solution turns to bubbles.

Figure 17:
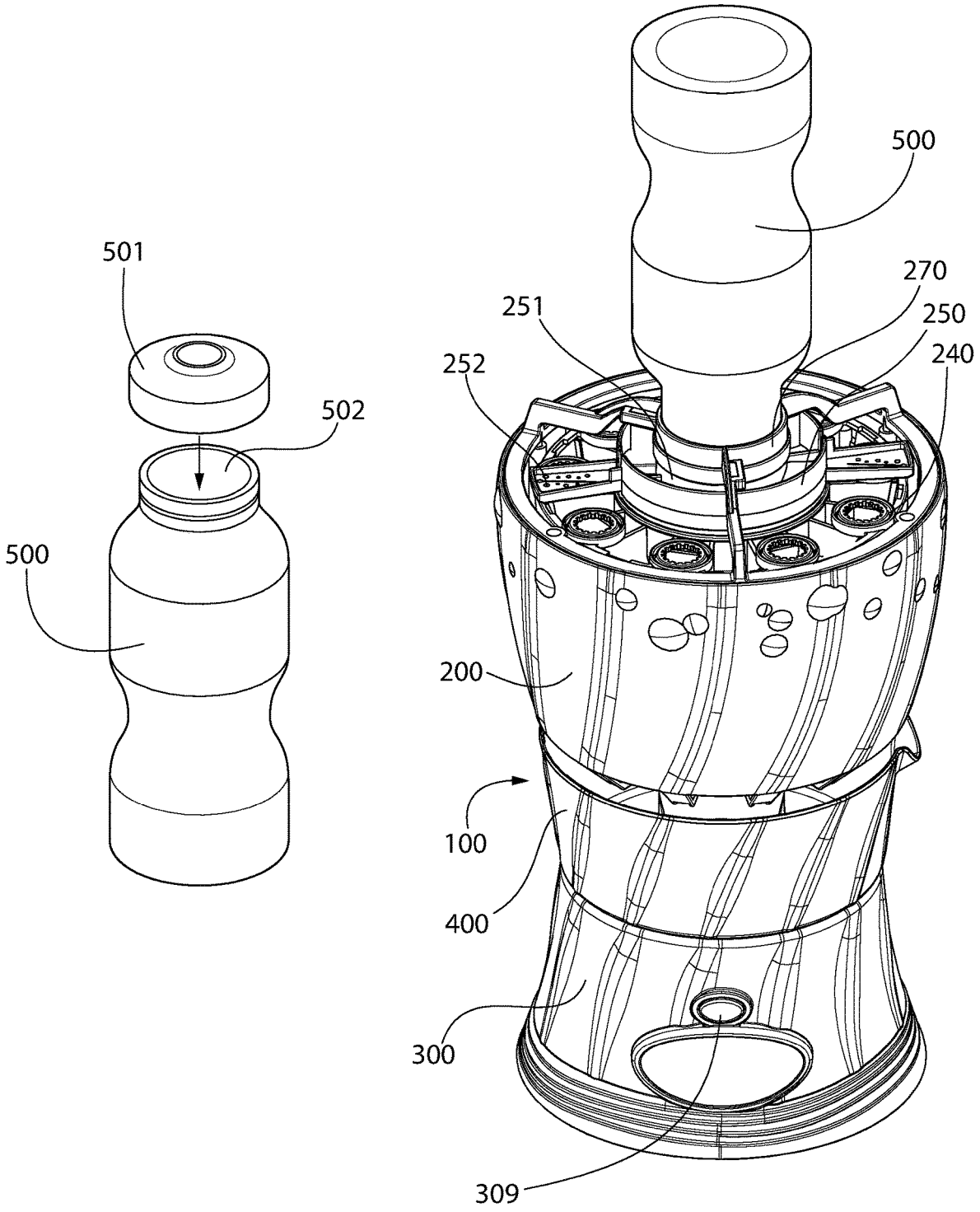
FIG. 17 illustrates the apparatus of FIG. 1 with a bottle containing a bubble solution coupled thereto in an upside-down orientation.

The bottle support structure formed by the inner ring structure 272 (alone or in combination with the first annular sidewall 255 of the hub portion 251 of the bubble solution dispenser 250) is arranged so as to surround a portion of the longitudinal axis A-A of the first housing assembly 200. Thus, when a bubble solution bottle is supported by the bottle support structure as described herein, the longitudinal axis A-A of the first housing assembly 200 passes through or intersects the bubble solution bottle. Specifically, the longitudinal axis A-A of the first housing assembly 200 coincides with the longitudinal axis of the bubble solution bottle when the bubble solution bottle is being supported by the bottle support structure. Stated another way, the support member 270 is configured to support a bubble solution bottle in an upside-down orientation at a position that is radially inward from the air stream so that the bubble solution bottle is at least partially surrounded by the air stream during operation of the fan device 210. Thus, the bubble solution bottle is supported centrally within the apparatus 100 during operation. FIG. 17 illustrates the apparatus 100 with a bubble solution bottle 500 coupled thereto in an upside-down orientation. As can be seen, the bubble solution bottle 500 is aligned with the longitudinal axis A-A and no portion of the bubble solution bottle extends radially beyond the boundary formed by the outer surface of the first housing assembly 200.

Figure 11:
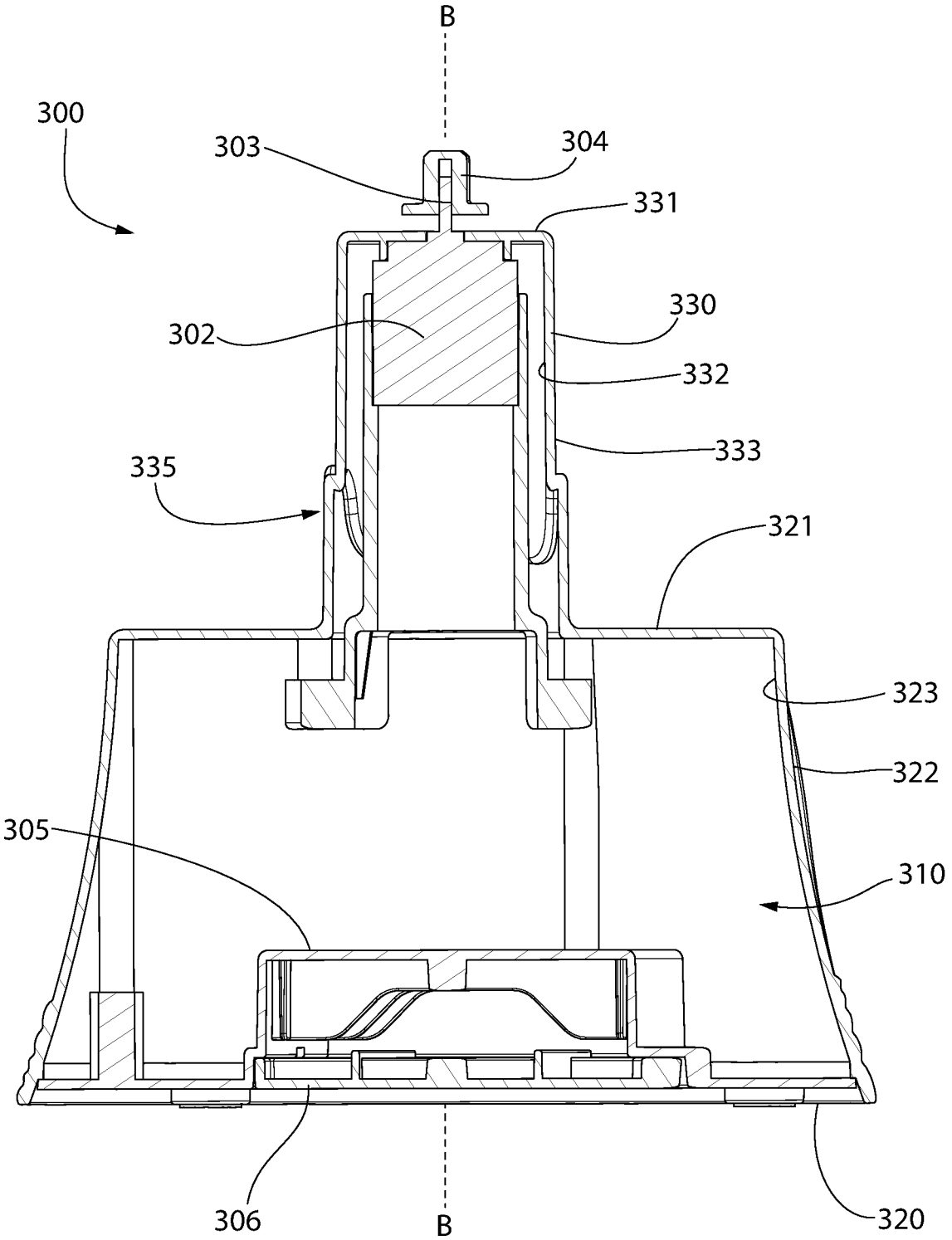
FIG. 11 illustrates a second housing assembly of the apparatus from the cross-sectional view of FIG. 2.
Figure 12:
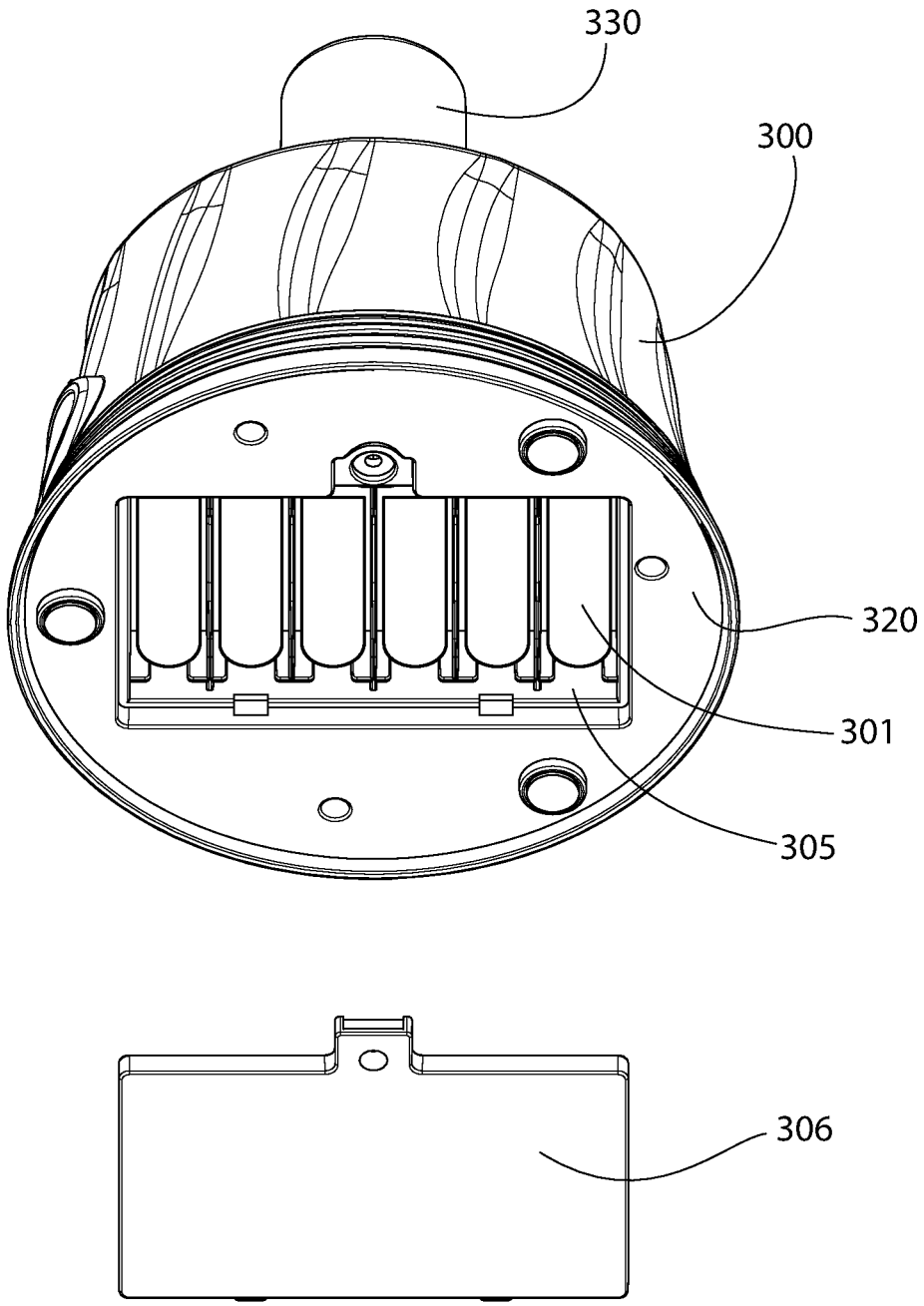
FIG. 12 is a bottom perspective view of the second housing assembly of the apparatus of FIG. 1 with a power source compartment cover removed to expose a power source.

Referring to FIGS. 11 and 12, the second housing assembly 300 and the electrical components housed therein will be further described. The second housing assembly 300 extends from a bottom end 320 to a top end 321 along an axis B-B. The second housing assembly 300 further comprises an outer surface 322 and an inner surface 323, the inner surface 323 defining the interior cavity 310. The second housing assembly 300 also has a power source compartment 305 for holding the power source 301, which in the exemplified embodiment is a plurality of batteries. The second housing assembly 300 may include a cover 306 that can be opened to provide access to the power source 301 to replace the batteries as needed.

The second housing assembly 300 comprises a connection post 330 protruding from the top end 321, the connection post 330 terminating in a distal end 331. The connection post 330 has an inner surface 332 that defines a cavity and an outer surface 333 opposite the inner surface 332. In the exemplified embodiment, the motor 302 is located within the connection post 330. Specifically, in the exemplified embodiment the motor 302 is located entirely within the cavity of the connection post 330. Of course, the invention is not to be so limited and in other embodiments only portions of the motor 330 may be located within the connection post 330. The drive shaft 303 of the motor 302 extends through an opening in the distal end 331 of the connection post 330 and protrudes from the distal end 331 of the connection post 330. The coupler 304 is then coupled to the drive shaft 303 of the motor 302 as described herein for operably coupling the motor 302 to the fan device 210 that is contained within the first housing assembly 200.

In the exemplified embodiment, the connection post 330 comprises an alignment feature 335. The alignment feature 335 may be a feature that protrudes from the outer surface 333 of the connection post 330. In the exemplified embodiment, the alignment feature 335 comprises an upper edge 336 that is wavy or undulates (see FIG. 14). The alignment feature 335 of the connection post 330 of the second housing assembly 330 is configured to mate/interact with an alignment feature of the drip tray 400 to facilitate a proper coupling between the drip tray 400 and the second housing assembly 300 while preventing relative rotation between the drip tray 400 and the second housing assembly 300 during normal operation of the apparatus 100. Thus, although it may be possible for a user to rotate the drip tray 400 relative to the second housing assembly 300, such relative rotation will not occur naturally during operation without user intervention. Although depicted as being a feature having a wavy/undulating upper edge, the alignment feature 335 may take on any structural shape or arrangement so long as it is configured to mate with an alignment feature of the drip tray 400 as described herein. Furthermore, in some embodiments the alignment feature 335 may be omitted as such omission may not affect the operation of the apparatus 100.

Figure 13:
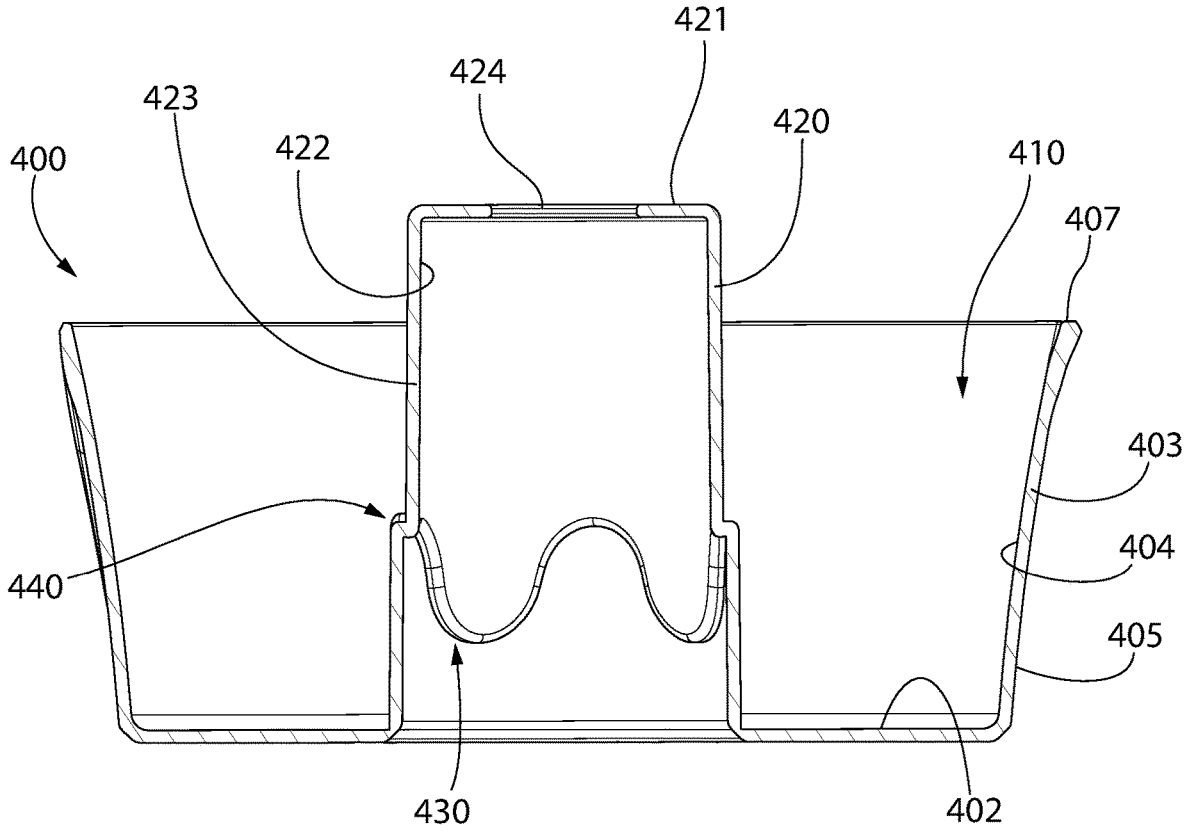
FIG. 13 illustrates a drip of the apparatus from the cross-sectional view of FIG. 2.

Referring to FIG. 13, the drip tray 400 will be further described. As noted above, the drip tray 400 comprises the floor 402 and the sidewall 403 that collectively define the collection reservoir 410. Furthermore, the drip tray 400 comprises an inner surface 404 that faces the collection reservoir 410 and an outer surface 405 opposite the inner surface 404. The collection reservoir 410 has an open top end so that bubble solution dripping from the bubble solution dispenser 250 that does not attach to the bubble generating assembly 240 can fall into the collection reservoir 410 of the drip tray 400 so that it can be recycled and reused.

The drip tray 400 also comprises a connection post 420 protruding from the floor 402 to facilitate coupling of the drip tray 400 to each of the first and second housing assemblies 200, 300. In the exemplified embodiment, the connection post 420 has a circular transverse cross-sectional shape. However, the invention is not to be so limited and the connection post 420 could have other transverse cross-sectional shapes so long as it is configured to mate with connection posts of the first and second housing assemblies 200, 300 as described herein. In the exemplified embodiment, the sidewall 403 has a first height measured from the floor 402 to a distal end 407 and the connection post 420 has a second height measured from the floor 402 to a distal end 421, the second height being greater than the first height. Thus, the connection post 420 extends beyond the sidewall 403. The connection post 420 has an inner surface 422 and an outer surface 423. The connection post 420 is hollow in the exemplified embodiment so that the connection post 330 of the second housing assembly 300 can be received therein when the apparatus 100 is assembled. The connection post 420 also comprises an opening 424 in the distal end 421 thereof so that the drive shaft 303 of the motor 302 can protrude through the opening 424 for coupling to the fan device 210 as described herein.

The drip tray 400 comprises a first alignment feature 430 and a second alignment feature 440. In the exemplified embodiment, the first alignment feature 430 is located on the inner surface 422 of the connection post 420 and the second alignment feature 440 is located on the outer surface 423 of the connection post 420. In the exemplified embodiment, each of the first and second alignment features 430, 440 have a wavy or undulating shape. However, the shapes of the first and second alignment features 430, 440 are not to be limiting in all embodiments. In the exemplified embodiment, the first alignment feature 430 of the drip tray 400 mates/interacts with the alignment feature 335 of the second housing assembly 300 and the second alignment feature 440 of the drip tray 400 mates/interacts with the alignment feature 209 of the first housing assembly 200. The interaction between these alignment features prevents relative rotation between the first housing assembly 200 and the drip tray 400 and between the second housing assembly 300 and the drip tray 400 when the apparatus 100 is assembled and operating. However, because the first housing assembly 200, the second housing assembly 300, and the drip tray 400 are coupled together without any fasteners, a user can rotate the components relative to one another if so desired.

Although the alignment features 209, 335, 430, 440 are illustrated and described herein as being located on the various connection posts 207, 330, 420 of the different components, the invention is not to be so limited in all embodiments. The reason for the alignment features 209, 335, 430, 440 in the exemplified embodiment is that the connection posts 207, 330, 420 have circular transverse cross-sectional shapes. As a result, simply coupling the various components (i.e., the first housing assembly 200, the second housing assembly 300, and the drip tray 400) together via the connection posts 207, 330, 420 will do nothing to prevent the various components from rotating relative to one another. Thus, in another embodiment the connection posts 207, 330, 420 may be modified to have a non-circular transverse cross-sectional shape (e.g., triangular, square, rectangular, etc.), and this shape will form the various alignment features 209, 335, 430, 440. Furthermore, in still other embodiments there may be no detriment to allowing for the first housing assembly 200, the second housing assembly 300, and the drip tray 400 to rotate relative to one another during operation, and in fact this may add another dimension of fun to the apparatus 100. Thus, the alignment features may be omitted entirely in some embodiments.

Figure 14:
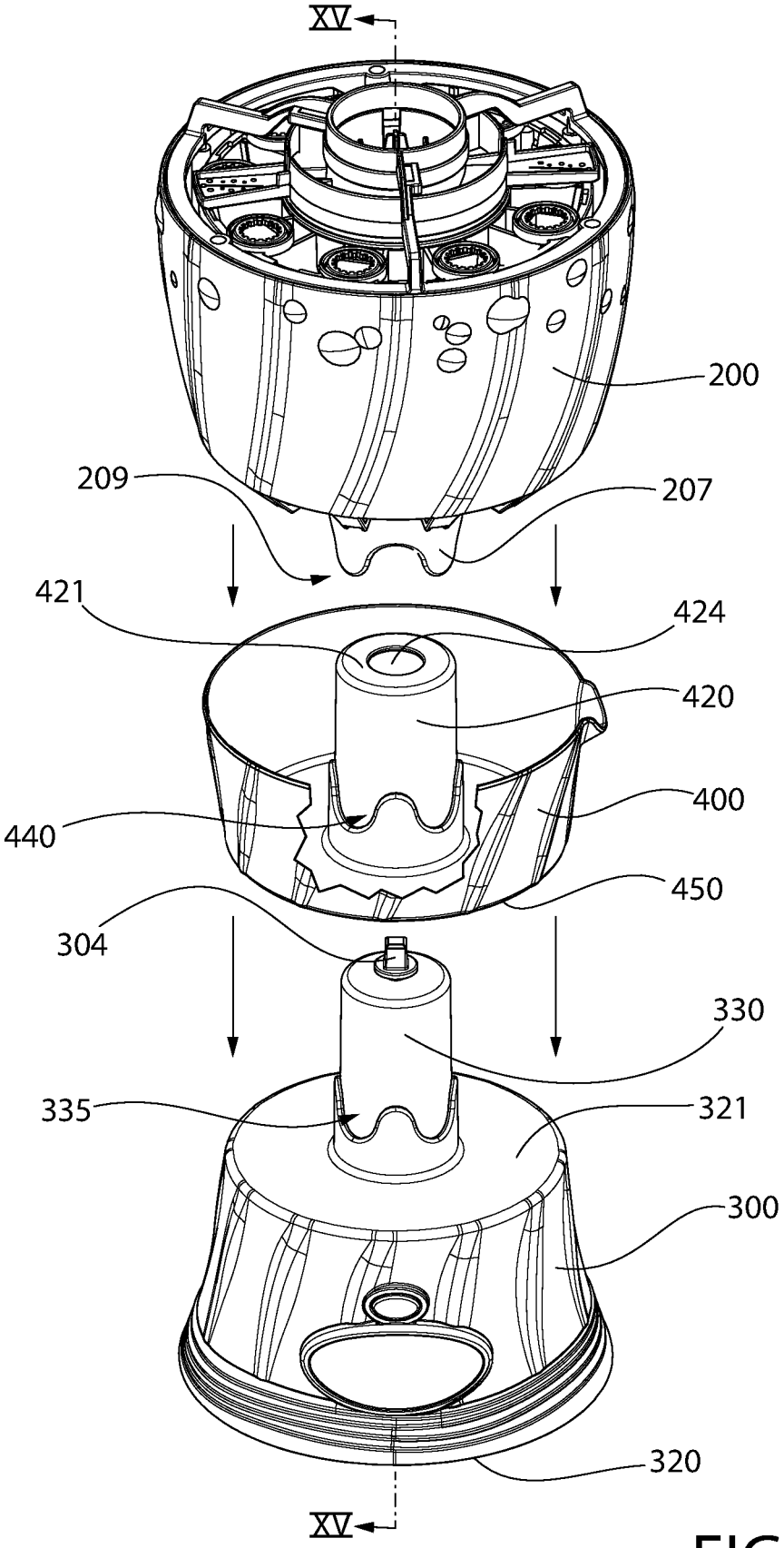
FIG. 14 is a perspective view of the apparatus of FIG. 1 illustrating the first housing assembly, the second housing assembly, and the drip tray in a detached state.
Figure 15:
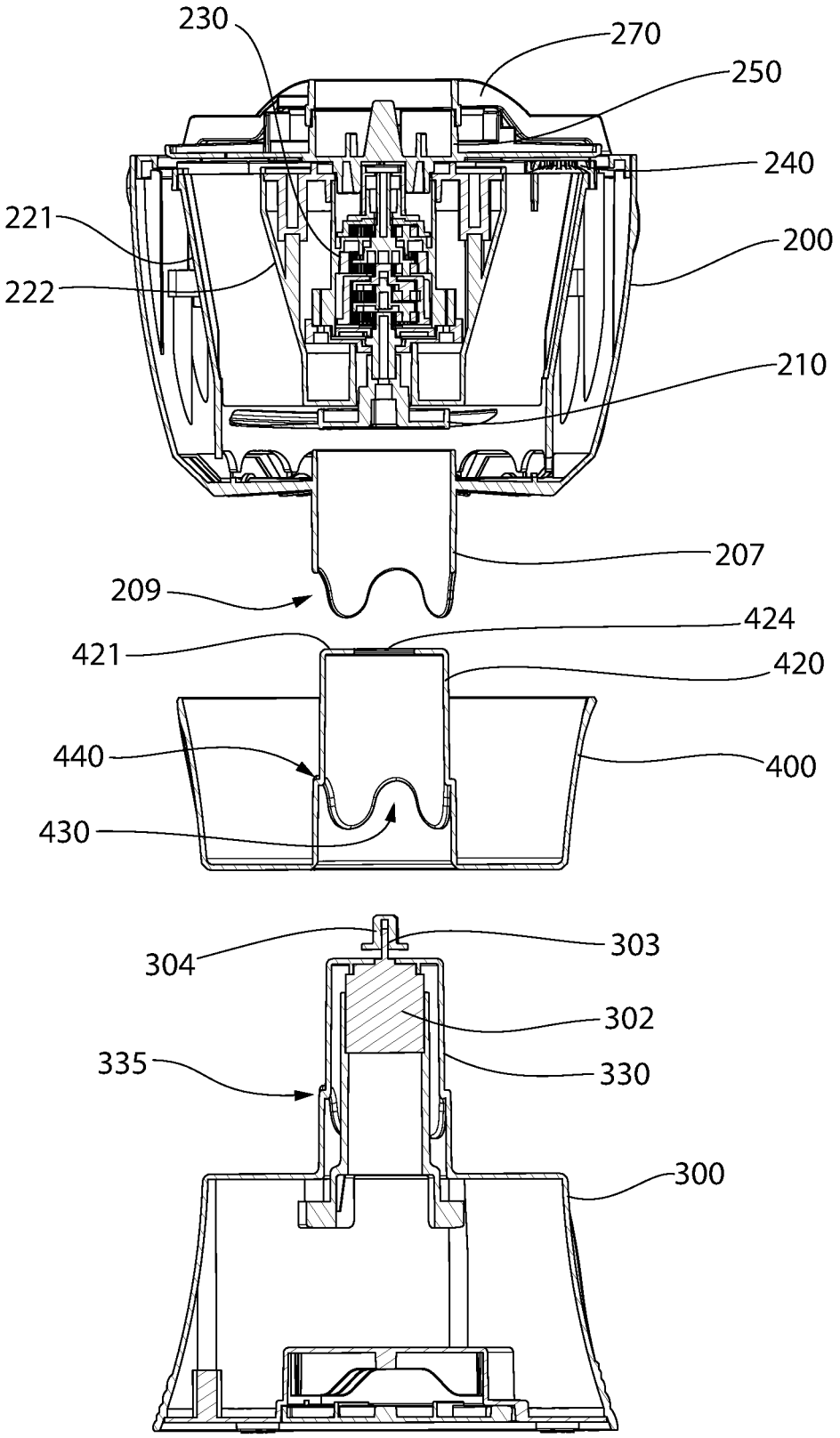
FIG. 15 is a cross-sectional view taken along line XV-XV of FIG. 14.
Figure 16:
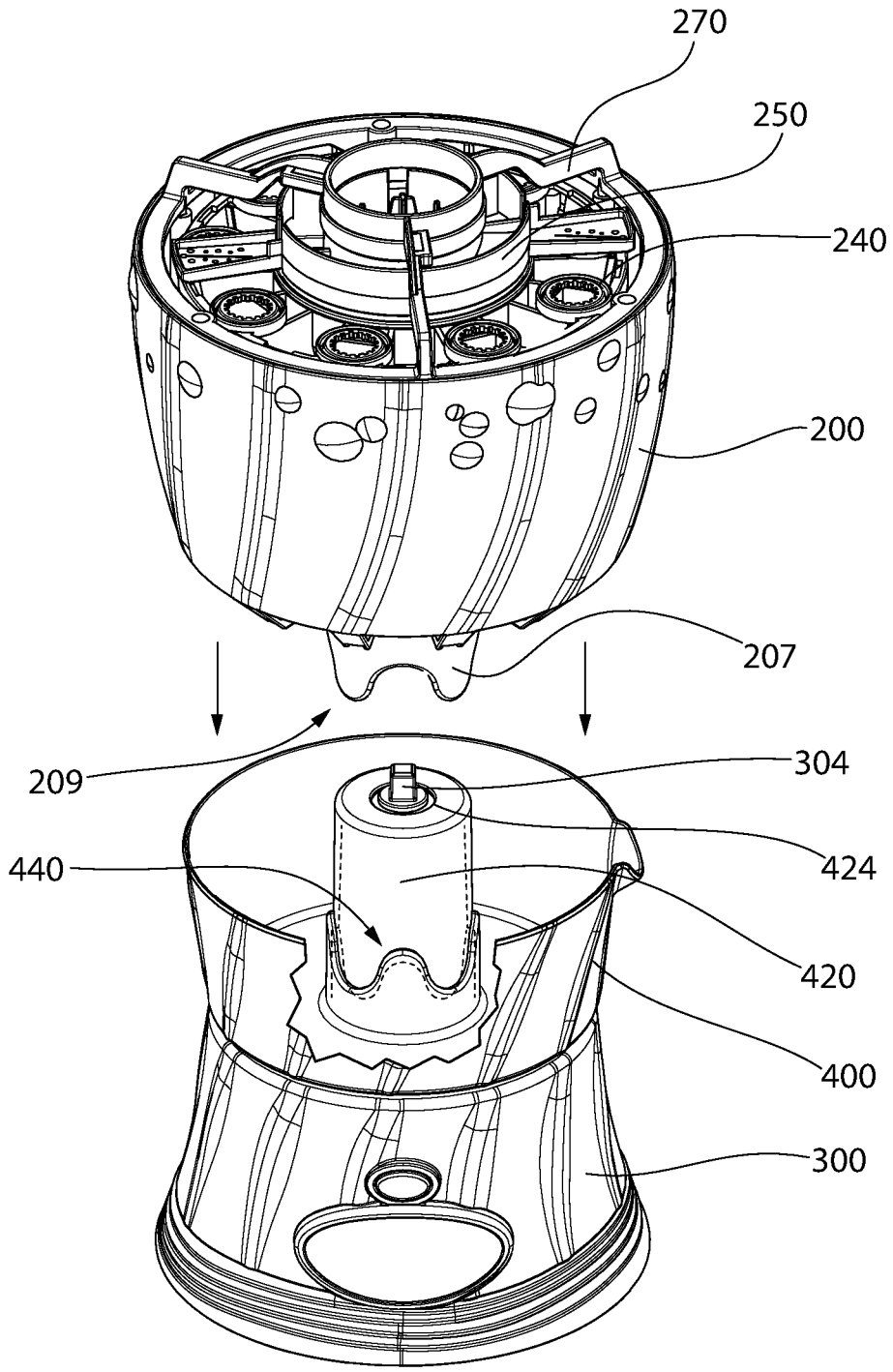
FIG. 16 is a perspective view of the apparatus of FIG. 1 with the second housing assembly and the drip tray coupled together and the first housing assembly detached therefrom to illustrate the process of assembling the apparatus.

Referring to FIGS. 14-16, the assembly of the apparatus 100 will be described. The apparatus 100 may be sold with the first housing assembly 200, the second housing assembly 300, and the drip tray 400 as separate components, although they could also be pre-assembled in other embodiments. The other parts of the apparatus 100 are generally already coupled to the respective one of the first and second housing assemblies 200, 300, although some additional assembly could be required by a consumer after purchase. As shown in FIG. 14-16, to assemble the apparatus 100, the second housing assembly 300 is placed onto a horizontal surface (i.e., a table, floor, ground, or the like) with the bottom end 320 in contact with the horizontal surface. Next, the drip tray 400 is coupled to the second housing assembly 300. This is accomplished by moving the drip tray 400 towards the second housing assembly 300 with a bottom end 450 of the drip tray 400 facing the top end 321 of the second housing assembly 300. The drip tray 400 is moved towards the second housing assembly 300 until the connection post 330 of the second housing assembly 300 nests within the interior of the connection post 420 of the drip tray 400 (see FIG. 16). Thus, the drip tray 400 is slidably detachably coupled to the second housing assembly 300 During this process, the drive shaft 303 of the motor 302 and the coupler 304 attached thereto extend through the opening 424 in the distal end 421 of the connection post 420 of the drip tray 400. Furthermore, the first alignment feature 430 of the drip tray 400 interacts/mates with the alignment feature 335 of the second housing assembly 300.

Next, the first housing assembly 200 is coupled to the drip tray 400 by moving the first housing assembly 200 towards the drip tray 400. During this process, the connection post 420 of the drip tray 400 enters into the connection post 209 of the first housing assembly 200 and nests therein. Thus, the second housing assembly 200 is slidably detachably coupled to the drip tray 400. Furthermore, the alignment feature 209 of the first housing assembly 200 mates with the second alignment feature 330 of the drip tray 440. Moreover, as the first housing assembly 200 is coupled to the drip tray 400, the coupler 304 that is attached to the drive shaft 303 of the motor 302 mates with and becomes operably coupled to the fan device 210. Thus, the process of assembling the first housing assembly 200, the drip tray 400, and the second housing assembly 300 also results in operably coupling the motor 302 (which is located within the second housing assembly 300) to the fan device 210 (which is located within the first housing assembly 200). The alignment features 209, 335, 430, 440 ensure that when the apparatus 100 is assembled, the coupler 304 is properly aligned with the first coupler 212 of the fan device 210 so that the coupler 304 and the first coupler 212 of the fan device 210 mate/interact as needed to ensure that the motor 302 rotates the fan device 210 during operation.

Referring briefly to FIG. 2, the interaction between the various connection posts 207, 330, 420 can be seen. Specifically, FIG. 2 best illustrates how the connection post 330 of the second housing assembly 300 nests within the interior of the connection post 420 of the drip tray 400 and how the connection post 420 of the drip tray 400 nests within the interior of the connection post 207 of the first housing assembly 200. The interaction of the various alignment features 209, 335, 430, 440 is also best seen in FIG. 2. Although the invention is described herein with certain ones of the connection posts 207, 330, 420 entering into and nesting within others, the invention is not to be limited by the exact interaction illustrated and described herein. In other embodiments, distal ends of the connection posts 207, 330, 420 may interact to couple the components together or the like. Thus, variations to that which is described herein may be possible in certain alternative embodiments and such variations and modifications would be readily apparent to persons skilled in the art.

Referring to FIGS. 1 and 2, the apparatus 100 is illustrated in a fully assembled state with the drip tray 400 coupled to the second housing assembly 300 and the first housing assembly 200 coupled to the drip tray 400. When so assembled, the outer surface 322 of the second housing assembly 300 is flush with the outer surface 405 of the drip tray 400. Thus, the outer surfaces 322, 405 of the second housing assembly 300 and the drip tray 400 are seamless and flush at their interface to give the apparatus 100 a clean appearance. In some embodiments, a bottom surface of the drip tray 400 may be in surface contact with the top surface 321 of the second housing assembly 300, such as depicted in FIG. 2.

However, when the first housing assembly 200 is coupled to the drip tray 400, an upper edge of the drip tray 400 (i.e., the distal end 407 of the sidewall 403 of the drip tray 400) is spaced apart from the bottom end 204 of the first housing assembly 200 by an annular air gap 199. This allows air to enter into the first housing assembly 200 from the bottom end 204 of the first housing assembly 200 when the fan device 210 is rotating. Thus, when the fan device 210 is rotating, the fan device 210 pulls air into the first housing assembly 200 through the annular air gap 199 so that the air stream that generates the bubbles can be generated. Of course, the invention is not to be so limited in all embodiments. In other embodiments, the first housing assembly 200 could be flush with the drip tray 400 when coupled thereto, and the first housing assembly 200 could have air openings that facilitate the entry of air into the first housing assembly 200 for the generation of the air stream as described herein.

Referring to FIGS. 17-19C, the operation of the apparatus 100 to generate bubbles from a bubble solution will be described. As shown in FIG. 17, first the apparatus 100 is assembled as described previously by attaching the drip tray 400 to the second housing assembly 300 and then attaching the first housing assembly 200 to the drip tray 400. There are no fasteners used to couple these components together. Rather, they merely rest one on top of the other and are held in place due to gravity. The alignment features described above may assist in properly orienting the first and second housing assemblies 200, 300 and the drip tray 400 relative to one another, although the alignment features may also be omitted in some embodiments.

Next, a bubble solution bottle 500 is provided. The bubble solution bottle 500 may be any container or the like having a cavity that is configured to hold and store an amount of a bubble solution. The bubble solution bottle 500 may have an open top end 502 that allows for the bubble solution in the bubble solution bottle 500 to be dispensed therefrom. The bubble solution bottle 500 may have a cap 501 thereon that closes the open top end 502 of the bubble solution bottle 500. The cap 501 may be coupled to the bubble solution bottle 500 with a hinge, with mating screw threads, interference fit, snap-fit, or in any other desired manner. To begin use of the apparatus 100, the bubble solution bottle 500 is oriented upside-down and placed so that the open top end 502 faces the storage reservoir 253 of the bubble solution dispenser 250. The support member 270 of the apparatus 100 may hold and retain the bubble solution bottle 500 in the upside-down orientation as shown in FIG. 17.

Figure 18A:
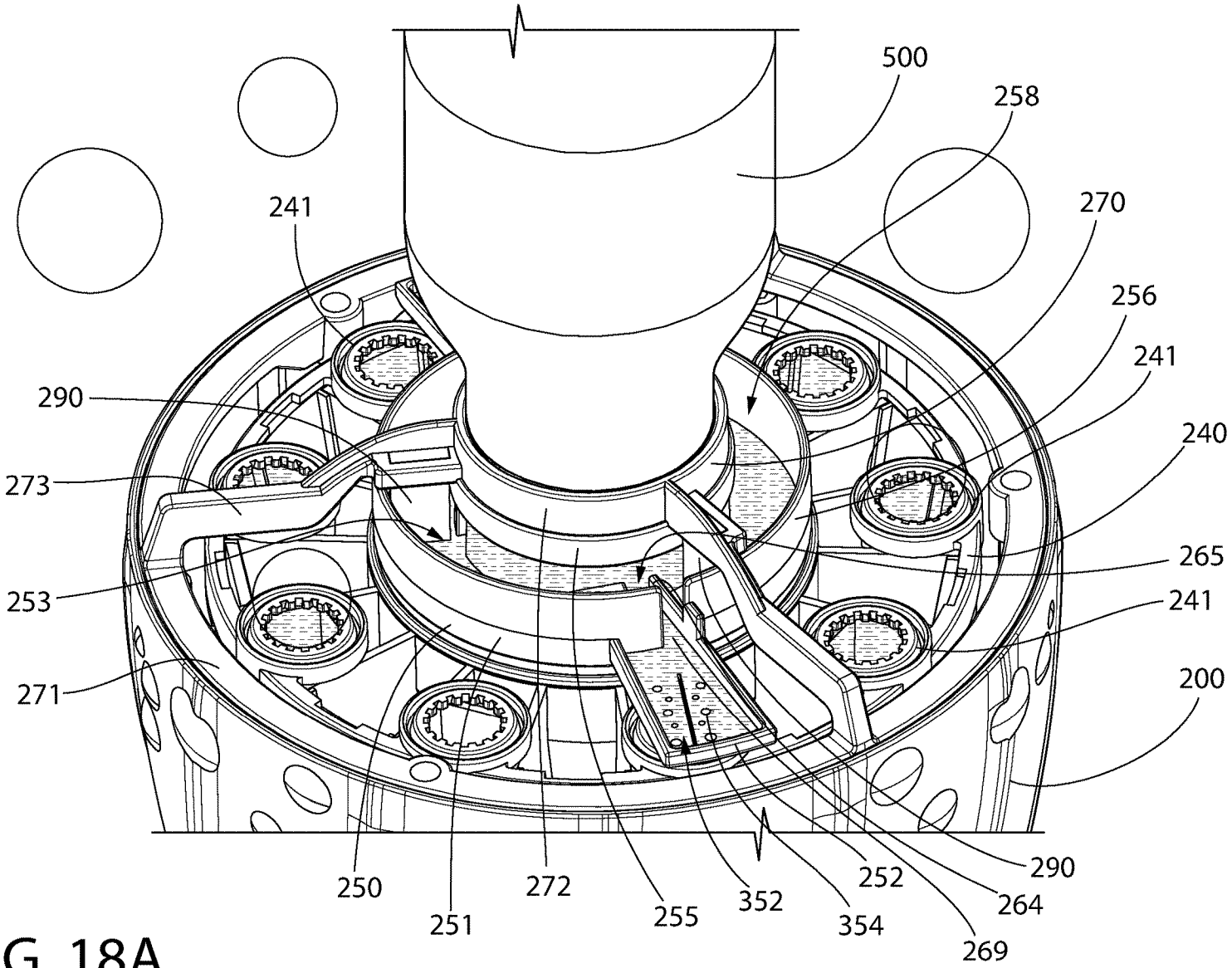
FIGS. 18A-18C illustrate the operation of the apparatus of FIG. 1 to generate bubbles.
Figure 18B:
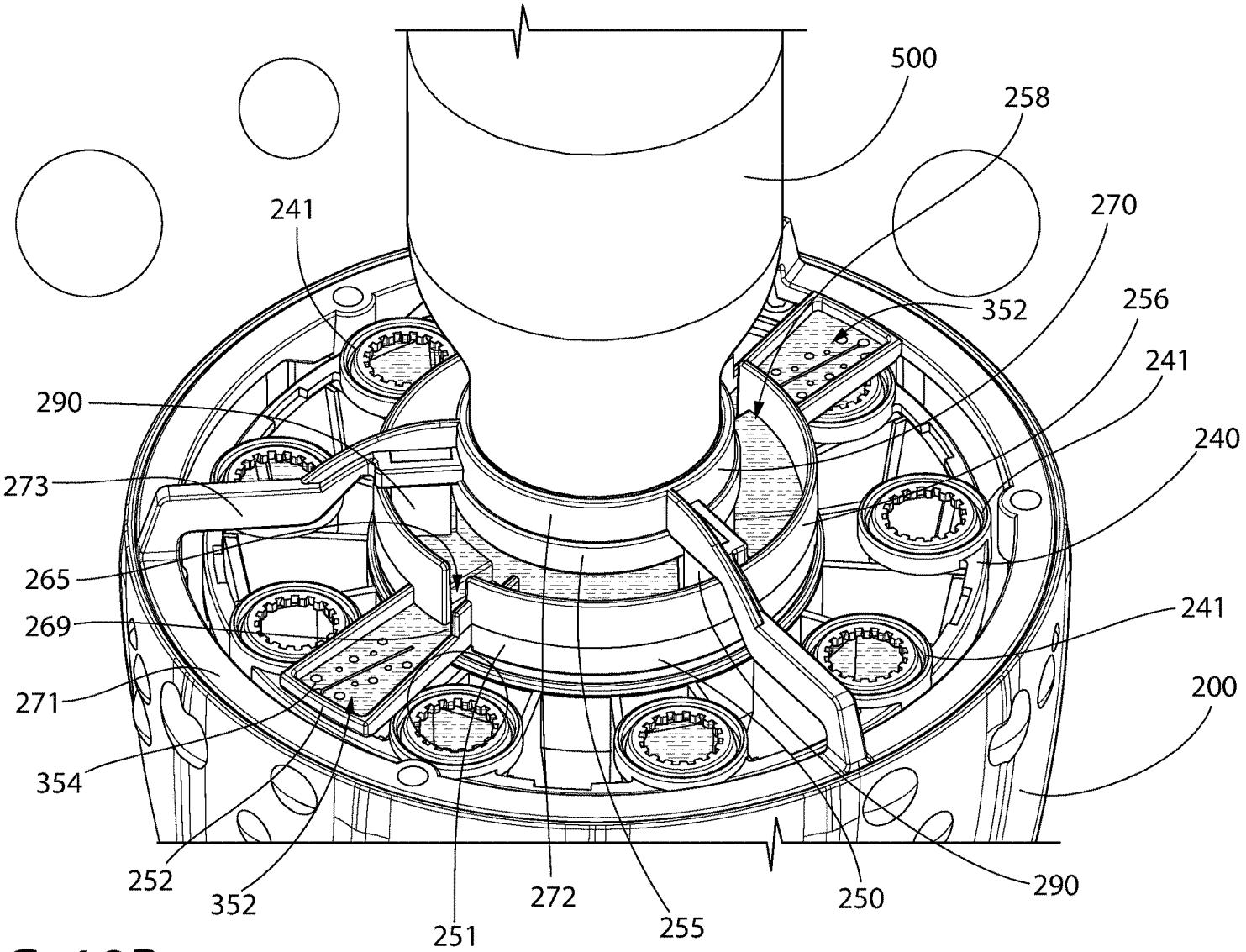
Figure 18C:
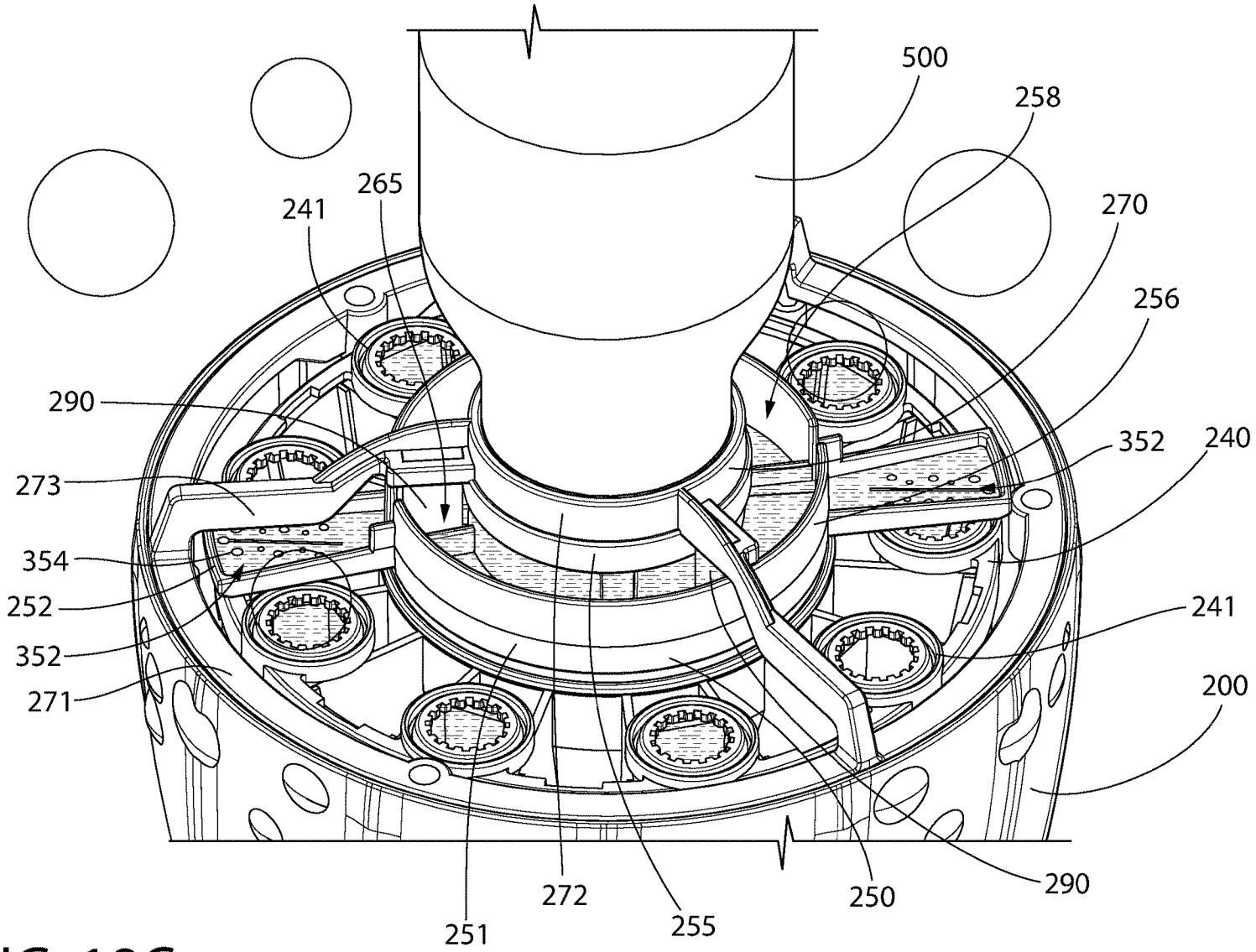
Figure 19B:
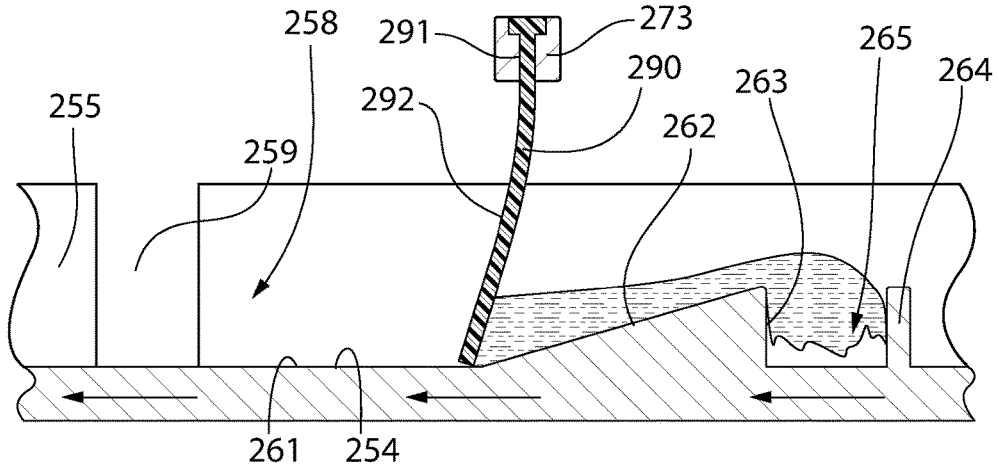
Figure 19C:
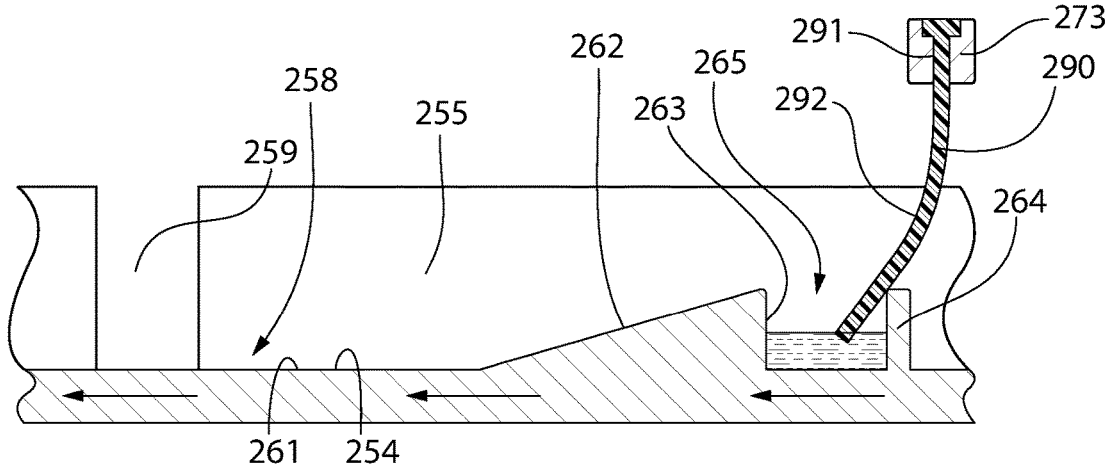

Referring sequentially to FIGS. 18A-18C concurrently with FIGS. 19A-19C, the operation will be further described. FIG. 19A is a schematic cross-sectional view associated with the relative positioning of the components depicted in FIG. 18A, FIG. 19B is a schematic cross-sectional view associated with the relative positioning of the components depicted in FIG. 18B, and FIG. 19C is a schematic cross-sectional view associated with the relative positioning of the components depicted in FIG. 18C.

Once the bubble solution bottle 500 is coupled to the apparatus 100 in its upside-down orientation, the bubble solution will flow out of the bubble solution bottle 500 and into the storage reservoir 253 of the hub portion 251 of the bubble solution dispenser 250. The bubble solution will flow into both of the first and second portions 257, 258 of the storage reservoir 253. However, without activating the apparatus 100 by pressing the actuator 309, in some embodiments the bubble solution will not flow to the deliver reservoir 352 of the delivery member 252. Thus, the bubble solution will not flow from the bottle 500 to the delivery reservoir 352 unless the bubble solution dispenser 250 is being moved by the motor 302. This is due to the ramping of the floor 254 of the second circumferential portion 262 of the storage reservoir 253 as described above and best depicted in FIGS. 19A-19C. Thus, until a user presses the actuator 309 to power the motor 302, the bubble solution will not flow to the delivery reservoir 352 and will therefore not be delivered onto the bubble generating apparatus 240. This may be preferable because otherwise the bubble solution would begin to drip downwardly from the delivery member 252 before the bubble solution dispenser 250 is rotating, which will likely result in much of that bubble solution simply dripping down to the drip tray 400 rather than being used to load the bubble generating devices 241. However, in other embodiments as noted above the ramped portion may be omitted so that upon the bubble solution bottle 500 being placed in the upside-down orientation as shown, the bubble solution will flow all the way to the delivery reservoir 352 for delivery to the bubble generating devices 241 of the bubble generating assembly 240.

As seen in FIGS. 18A and 19A, the paddles 290 are each supported from above by one of the arm members 273 of the support member 270. In the exemplified embodiment, the paddles 290 are formed from a resilient material, such as for example an elastomeric material, a rubber, a thermoplastic elastomer, or the like. The paddles 290 may also be formed of other resilient materials, including a flexible plastic, so long as the paddles 290 are configured to operate/function as described herein. An upper portion 291 of each of the paddles 290 is fixed to one of the arm members 273 and a lower portion of each of the paddles 290 hangs downwardly from the arm member 273 without being physically coupled to any other structure. Thus, the paddles 290 are suspended by the arm members 273 within the second portion 258 of the storage reservoir 253 of the hub portion 251 of the bubble solution dispenser 250. In other words, the paddles 290 are suspended from the arm members 273 in a cantilevered manner.

The support member 270 is fixed to the first housing assembly 200 so as to be static or non-movable relative to the first housing assembly 200. Thus, the paddles 290 are also in a fixed position relative to the first housing assembly 200 due to their being coupled directly to one of the arm members 273 of the support member 270. In the exemplified embodiment, the paddles 290 do not rotate during operation but rather they remain fixed as the bubble solution dispenser 250 rotates as described herein. Thus, the location of the paddles 290 within the bubble solution dispenser 250 changes, but only due to the rotation of the bubble solution dispenser 250 and not due to any movement of the paddles 290. Of course, in other embodiments the paddles 290 and the bubble generating assembly 240 may rotate while the bubble solution dispenser 250 stays static, in other embodiments the paddles 290 and the bubble solution dispenser 250 may rotate in opposite rotational directions while the bubble generating assembly 240 remains static, and in other embodiments the paddles 290 may rotate while the bubble solution dispenser 250 and the bubble generating assembly 240 remain static. Thus, there are variations that are possible in terms of which component is moving/rotating in alternative embodiments while still enabling the apparatus to function as described herein. However, the paddles 290 and the bubble solution dispenser 250 should move or rotate relative to one another to facilitate movement of the bubble solution to the delivery reservoir 352 as described herein.

Although the paddles 290 are described as being in a fixed position in the exemplified embodiment and being static relative to the first housing assembly 200, it should be appreciated that the paddles 290 are able to flex and move as the apparatus 100 is operating. This is because only the upper portions 291 of the paddles 290 are affixed to the support member 270 with the lower portions 292 of the paddles 290 hanging freely below the support arms 273 within the second portion 258 of the storage reservoir 253. This allows the lower portions 292 of the paddles 290 to flex or move relative to the upper portions 291 of the paddles 290 as the paddles 290 contact the bubble solution in the storage reservoir 253 or the floor 254 of the storage reservoir 253 (as shown in FIGS. 19A-19C).

Referring collectively to FIGS. 18A-19C, during operation the motor 302 rotates, which causes the fan device 210 to rotate and generate an air stream and also causes the bubble solution dispenser 250 to rotate. In some embodiments, the bubble solution dispenser 250 may rotate in a clockwise direction (as shown in the exemplified embodiment), but the invention is not to be so limited and the bubble solution dispenser 250 could alternatively rotate in a counterclockwise direction. As the bubble solution dispenser 250 rotates, the paddles 290 contact the bubble solution located in the second portion 258 of the storage reservoir 253. The bubble solution is unable to flow up the second circumferential portion 262 of the second portion 258 of the storage reservoir 253 due to its ramped configuration. However, as the bubble solution dispenser 250 rotates, the paddles 290 contact the bubble solution and move (or drive) it upwardly along the second circumferential portion 262 of the second portion 258 of the storage reservoir 253 (see FIG. 19B).

Eventually, the paddles 290 drive or otherwise move the bubble solution to the terminal end 263 of the second circumferential portion 262 of the floor 254 of the second portion 258 of the storage reservoir 253. At such time, the bubble solution flows into the dispensing portion 265 of the storage reservoir 253 that is located between the stopper wall 264 and the terminal end 263 of the second circumferential portion 262 of the floor 254 of the second portion 258 of the storage reservoir 253. From the dispensing portion 265, the bubble solution readily flows through the opening 269 in the second annular sidewall 256 to the delivery reservoir 352. Once in the delivery reservoir 352, the bubble solution flows out through the apertures 354 and either: (1) onto one of the bubble generating devices 241 of the bubble generating assembly 240; or (2) into the drip tray 400.

As noted above, during operation the bubble solution dispenser 250 is rotating about the rotational axis R1-R1. As the bubble solution dispenser 250 rotates, the delivery member 252 passes across different ones of the bubble generating devices 241. The delivery member 252 passes over the top of the bubble generating devices 241 in the exemplified embodiment, although the delivery member 252 could pass beneath the bubble generating devices 241 in other embodiments as described above. Furthermore, the bubble solution located in the delivery reservoir 352 of the delivery member 252 of the bubble solution dispenser 350 continuously drips out through the apertures 354. Thus, as the bubble solution dispenser 250 rotates, the bubble solution dispenser 250 dispenses the bubble solution onto each of the bubble generating devices 241 in succession. The process continues because as the bubble solution dispenser 250 rotates, the paddles 290 continue to drive or otherwise move the bubble solution into the dispensing portion 265 of the storage reservoir 253, from where the bubble solution flows into the delivery reservoir 352 for delivery onto the different bubble generating devices 241.

As noted above, the bubble generating devices 241 of the bubble generating assembly 240 are positioned so as to be aligned with the air stream generated by the fan device 210. As the air stream generated by the fan device 210 passes the bubble generating devices 241 that are loaded with the bubble solution, bubbles are formed as depicted in FIGS. 18A-18C. Then, the bubble solution dispenser 250 will dispense an additional amount of the bubble solution onto the bubble generating devices 241 and the process continues indefinitely until either the power source 301 runs out of power, the user powers the device off (by activating the actuator 309 a second time), or the bubble solution bottle 500 and the storage reservoir 253 becomes depleted of bubble solution.

After use, a user can power the apparatus 100 off by activating the actuator 309. Next, the user detaches the first housing assembly 200 from the drip tray 400. The first housing assembly 200 can then be washed under a sink faucet or hose as may be desired. The first housing assembly 200 does not contain or otherwise include any electronic components so washing or rinsing the first housing assembly 200 does not harm its functionality. Next, the drip tray 400 is carefully detached from the second housing assembly 200. Once detached, a user can pour the bubble solution that was collected in the drip tray 400 back into the bubble solution bottle 500 or into another desired location. The drip tray 400 can then also be washed or rinsed under water. Finally, a user can wipe off the second housing assembly 200. The user may not want to wash or rinse the second housing assembly 200 because it contains all of the electronics for the apparatus 100. However, the second housing assembly 200 can be satisfactorily cleaned by wiping it with a dry or damp cloth, towel, or the like. The second housing assembly 300 is generally kept away from the bubble solution during use because the bubble solution is only intended to contact the first housing assembly 200 and the drip tray 400 and thus there should not be much bubble solution to clean off of the second housing assembly 300 after use. The apparatus 100 may then be set aside and stored either as separate components in the disassembled state or in the assembled state after being reassembled.

As used throughout, ranges are used as shorthand for describing each and every value that is within the range. Any value within the range can be selected as the terminus of the range. In addition, all references cited herein are hereby incorporated by referenced in their entireties. In the event of a conflict in a definition in the present disclosure and that of a cited reference, the present disclosure controls.

While the invention has been described with respect to specific examples including presently preferred modes of carrying out the invention, those skilled in the art will appreciate that there are numerous variations and permutations of the above described systems and techniques. It is to be understood that other embodiments may be utilized and structural and functional modifications may be made without departing from the scope of the present invention. Thus, the spirit and scope of the invention should be construed broadly as set forth in the appended claims.

What is claimed is:

1. An apparatus for generating bubbles comprising:

a first housing assembly comprising a longitudinal axis;

a motor;

a fan device operably coupled to the motor to generate an air stream;

a bubble generating assembly comprising a plurality of bubble generating devices that are aligned with the air stream generated by the fan device, the plurality of bubble generating devices fixed relative to the first housing assembly;

a bubble solution dispenser comprising a hub portion and at least one delivery member extending radially from the hub portion, the at least one delivery member comprising a delivery reservoir that is fluidly coupled to a supply of a bubble solution;

wherein the motor is operably coupled to the bubble solution dispenser to rotate the bubble solution dispenser about a rotational axis, wherein the at least one delivery member passes over a top of each of the bubble generating devices to load each of the bubble generating devices with the bubble solution as the bubble solution dispenser rotates about the rotational axis; and wherein the bubble generating devices are located between the at least one delivery member and the fan device in a direction of the longitudinal axis as the at least one delivery member passes over the bubble generating devices.

2. The apparatus according to claim 1 wherein the bubble generating assembly is non-rotatable relative to the first housing assembly so that the bubble generating devices are in a fixed position relative to the first housing assembly.

3. The apparatus according to claim 1 further comprising a bottle support structure for supporting a bottle containing the bubble solution in an upside-down orientation so that the bubble solution can flow from the bottle to the delivery reservoir, wherein the bottle is supported at a location so that the longitudinal axis of the first housing assembly coincides with a longitudinal axis of the bottle.

4. The apparatus according to claim 1 wherein the hub portion of the bubble solution dispenser comprises a storage reservoir, and further comprising at least one paddle at least partially positioned within the storage reservoir, wherein the at least one paddle moves the bubble solution from the storage reservoir to the delivery reservoir as the bubble solution dispenser rotates about the rotational axis.

5. The apparatus according to claim 4 wherein the at least one paddle is formed of a resilient material, the at least one paddle being suspended within the storage reservoir in a fixed position relative to the first housing assembly so that a lower portion of the at least one paddle flexes as the bubble solution dispenser rotates about the rotational axis due to contact between the lower portion of the at least one paddle and the bubble solution located in the storage reservoir.

6. The apparatus according to claim 4 wherein the storage reservoir comprises a first portion and a second portion that surrounds the first portion, the at least one paddle being located within the second portion of the storage reservoir and remaining in the second portion of the storage reservoir as the bubble solution dispenser rotates about the rotational axis, wherein a floor of the second portion of the storage reservoir comprises a first circumferential portion and a second circumferential portion, the second circumferential portion extending from the first circumferential portion to a terminal end and being inclined relative to the first circumferential portion.

7. The apparatus according to claim 6 further comprising a stopper wall extending upwardly from the floor of the second portion of the storage reservoir, the storage reservoir comprising a dispensing portion located between the stopper wall and the terminal end of the second circumferential portion of the floor for guiding the bubble solution into the delivery reservoir of the at least one delivery member.

8. The apparatus according to claim 1 further comprising a drip tray detachably coupled to the first housing assembly and configured to catch and hold the bubble solution that drips from the at least one delivery member of the bubble solution dispenser and is not loaded onto the bubble generating devices of the bubble generating assembly.

9. The apparatus according to claim 8 wherein the fan device is located within the first housing assembly, and further comprising a second housing assembly, a power source and the motor located in the second housing assembly and operably coupled together, a drive shaft of the motor protruding from a top end of the second housing assembly and configured to be operably coupled to the fan device, wherein the drip tray is detachably coupled to the first and second housing assemblies and located axially in between the first and second housing assemblies.

10. The apparatus according to claim 1 wherein the fan device is operably coupled to the bubble solution dispenser by a gear train, and wherein the fan device rotates about the rotational axis at a first rotational velocity and the bubble solution dispenser rotates about the rotational axis at a second rotational velocity that is less than the first rotational velocity.

11. The apparatus according to claim 1 wherein the at least one delivery member comprises a floor having at least one aperture therein so that the bubble solution falls through the at least one aperture via gravity to load the bubble solution onto the bubble generating devices of the bubble generating assembly as the at least one delivery member passes over the bubble generating devices.

12. The apparatus according to claim 1 further comprising an air passageway configured to guide the air stream from the fan device to the bubble generating devices, the air passageway diverging in a direction from the fan device to the bubble generating devices.

13. An apparatus for generating bubbles comprising:

a housing assembly;

a motor;

a fan device operably coupled to the motor to generate an air stream;

a bubble generating assembly comprising at least one bubble generating device that is aligned, or can be brought into alignment, with the air stream generated by the fan device;

a bubble solution dispenser comprising a storage reservoir containing a supply of bubble solution and at least one delivery member extending radially from the storage reservoir and being fluidly coupled thereto, the motor operably coupled to the bubble solution dispenser to rotate the bubble solution dispenser about a rotational axis relative to the bubble generating assembly; and at least one paddle positioned within the storage reservoir of the bubble solution dispenser, wherein the at least one paddle contacts the bubble solution in the storage reservoir of the bubble solution dispenser as the bubble solution dispenser rotates about the rotational axis to move the bubble solution from the storage reservoir to the at least one delivery member to load the at least one bubble generating device of the bubble generating assembly.

14. The apparatus according to claim 13 wherein the at least one paddle is suspended from above so that a lower portion of the at least one paddle hangs freely within the storage reservoir of the bubble solution dispenser.

15. The apparatus according to claim 14 wherein the at least one paddle is formed of a resilient material, and wherein the at least one paddle is suspended within the storage reservoir in a fixed position relative to the housing assembly so that as the bubble solution dispenser rotates about the rotational axis relative to the at least one paddle, the lower portion of the at least one paddle flexes due to contact between the lower portion of the at least one paddle and the bubble solution located in the storage reservoir.

* * * * *